US008428924B2

(12) United States Patent
Shook et al.

(10) Patent No.: US 8,428,924 B2
(45) Date of Patent: Apr. 23, 2013

(54) SYSTEM AND METHOD FOR EVALUATING DYNAMIC HETEROGENEITY IN EARTH MODELS

(75) Inventors: George Michael Shook, Houston, TX (US); Kameron Monroe Mitchell, Riau (ID)

(73) Assignee: Chevron U.S.A. Inc., San Ramon, CA (US)

( * ) Notice: Subject to any disclaimer, the term of this patent is extended or adjusted under 35 U.S.C. 154(b) by 546 days.

(21) Appl. No.: 12/637,898

(22) Filed: Dec. 15, 2009

(65) Prior Publication Data

US 2010/0161292 A1 Jun. 24, 2010

Related U.S. Application Data

(60) Provisional application No. 61/122,501, filed on Dec. 15, 2008.

(51) Int. Cl.
*G06G 7/58* (2006.01)

(52) U.S. Cl.
USPC ..... 703/10; 703/9; 166/252.6; 166/254.1; 166/245; 166/302; 166/257

(58) Field of Classification Search ..... 703/10, 703/9; 702/13; 166/302, 303, 263, 272.1
See application file for complete search history.

(56) References Cited

U.S. PATENT DOCUMENTS

| | | | | |
|---|---|---|---|---|
| 2006/0020438 | A1* | 1/2006 | Huh et al. | 703/10 |
| 2009/0150097 | A1* | 6/2009 | Camilleri | 702/45 |
| 2010/0191516 | A1* | 7/2010 | Benish et al. | 703/10 |
| 2011/0320128 | A1* | 12/2011 | Shook | 702/13 |

FOREIGN PATENT DOCUMENTS

| | | |
|---|---|---|
| EP | 0745870 | 12/1996 |
| GB | 2445246 | 7/2008 |
| WO | WO02054332 | 7/2002 |

OTHER PUBLICATIONS

Y Wang, A. R. Kovscek A Streamine Approach for Ranking Reservoir Models that Incorporates Production History SPE 77377, 2002.*
Eduardo A. Idrobot, Manoj K. Choudhary, A. Datta-Gupra Swept Volume Calculation and Ranking of Geostatistical Reservoir Models Using Streamline Simulation SPE 62557, 2000.*
Marco R. Thiele Streamline Simulation 8th International Forum on Reservoir Simulation, Jun. 20, 2005.*
Didem Senocak, Stephen Pennell, Charles Gibson, Richard Hughes Effective Use of Heterogeneity Measures in the Evaluation of a Mature CO2 Flood, SPE 113977 SPE, Apr. 19, 2008.*
International Preliminary Report on Patentability, PCT/US2009/068088, Jun. 30, 2011.

* cited by examiner

*Primary Examiner* — Saif Alhija
*Assistant Examiner* — Cuong Luu
(74) *Attorney, Agent, or Firm* — Craig Vander Ploeg; Nicholas F. Gallo; Christopher D. Northcutt

(57) ABSTRACT

A method is disclosed having application notably towards ranking earth models responsive to dynamic heterogeneity. A plurality of earth models representing a subsurface reservoir are provided. Streamline analysis for each of the plurality of earth models is conducted. Flow Capacity (F) vs. Storage Capacity (Φ) curves are constructed for each of the plurality of earth models based on the streamline analysis. Dynamic heterogeneity for each of the plurality of earth models is computed from the Flow Capacity (F) vs. Storage Capacity (Φ) curves constructed for each of the plurality of earth models. The plurality of earth models are ranked responsive to dynamic heterogeneity.

18 Claims, 22 Drawing Sheets

Lorentz

| | | 1 CONSTANT | B3 VDP | C3 lamda X | D3 lamdaZ | E3 RL | B3^2 VDP^2 | C3^2 lamda X^2 | D3^2 lamdaZ^2 | E3^2 RL^2 |
|---|---|---|---|---|---|---|---|---|---|---|
| CONSTANT | 1 | 0.32856 | | | | | | | | |
| VDP | B3 | -0.3491 | 0.743881 | | | | | | | |
| lamda X | C3 | 0.004645 | 0.00629 | -0.00018 | | | | | | |
| lamdaZ | D3 | -0.02985 | -0.09989 | 0.00443 | -0.0168 | | | | | |
| RL | E3 | -0.00061 | 0.001349 | -8.5E-06 | 0.00193 | -3.2E-05 | | | | |
| VDP^2 | B3^2 | | | | | | | | | |
| lamda X^2 | C3^2 | | | | | | 0 | | | |
| lamdaZ^2 | D3^2 | | | | | | 0 | 0 | | |
| RL^2 | E3^2 | | | | | | | | 0 | |

FIG. 10

SYSTEM AND METHOD FOR EVALUATING DYNAMIC HETEROGENEITY IN EARTH MODELS

CROSS-REFERENCE TO RELATED APPLICATION

The present application for patent claims the benefit of U.S. Provisional Application for patent bearing Ser. No. 61/122,501, filed on Dec. 15, 2008, the entirety of the application is incorporated herein by reference.

FIELD OF THE INVENTION

The present invention generally relates to a system and method for evaluating dynamic heterogeneity in earth models, and more particularly, to a system and method for ranking earth models based on dynamic heterogeneity.

BACKGROUND OF THE INVENTION

Earth models are utilized in the petroleum industry to understand the nature of a particular subsurface reservoir. Earth models provide a numerical representation of a reservoir property as a function of location and are constructed in the form of a single geological representation. Earth models are typically constrained or shaped by empirical data of the reservoir, such as seismic data, geologic data, drilling data, and production data. Geoscientists typically construct a plurality of earth models using stochastic techniques, such that the earth models represent extremes in reservoir porosity, water saturation, and permeability. The individual models can be analyzed to evaluate the geological uncertainty of the subsurface reservoir. For example, the earth models can be simulated under various operating scenarios to forecast the hydrocarbon production of the subsurface reservoir and the simulation runs can be interpreted and analyzed to obtain simple fluid flow characteristics of the subsurface reservoir. For instance, various well patterns can be implemented to see how they impact the forecasted production. Such evaluation is typically performed by determining static measures of heterogeneity for a given model.

Static measures of heterogeneity concentrate on the level of permeability variation in a reservoir. To calculate static measures of heterogeneity for a given model, Dykstra-Parsons and Lorenz coefficients can be calculated. These coefficients are typically derived from a Lorenz plot constructed from the model's permeability, layer thickness, and porosity distributions. Simple flow geometries can be determined for a reservoir by generating flow capacity-storage capacity curves, which are based on static data. There are many methods known in the art for plotting flow capacity-storage capacity curves, which are also commonly referred to as F-C curves or F-Φ curves.

As an example, flow capacity-storage capacity curves can be constructed for individual flow paths within a layered reservoir. In this case, the flow paths are represented as layers that have unique values of permeability, porosity, cross sectional area, and length. The flow capacity of an individual streamline can be described as the volumetric flow of that layer, divided by the total volumetric flow. Therefore, the flow capacity $f_i$ can be computed using Darcy's law and defining N layers each having a different permeability k, porosity ϕ, and thickness h using the following equation:

$$f_i = \frac{q_i}{\sum_{i=1}^{N} q_i} = \frac{(kh)_i}{\sum_{i=1}^{N} (kh)_i} \quad \text{(Equation 1)}$$

Similarly, the storage capacity of layer "i" can be computed as the layer pore volume divided by the total pore volume:

$$c_i = \frac{V_{Pi}}{\sum_{i=1}^{N} V_{Pi}} = \frac{(\varphi h)_i}{\sum_{i=1}^{N} (\varphi h)_i} \quad \text{(Equation 2)}$$

A F-C diagram is constructed by computing the cumulate distribution function of f and c. Therefore, the cumulative distribution functions for $F_i$, which represents the volumetric flow of all layers, and for $C_i$, which represents the pore volume associated with those layers, can be written as:

$$F_i = \frac{\sum_{j=1}^{i} q_j}{\sum_{j=1}^{N} q_i} = \frac{\sum_{j=1}^{i} (kh)_j}{\sum_{j=1}^{N} (kh)_j} \quad \text{(Equation 3)}$$

$$C_i = \frac{\sum_{j=1}^{i} Vp_j}{\sum_{j=1}^{N} Vp_j} = \frac{\sum_{j=1}^{i} (\varphi h)_j}{\sum_{j=1}^{N} (\varphi h)_j} \quad \text{(Equation 4)}$$

Calculations using Equations 1-4 for a simple 5-layer model are provided as an example:

| h (ft) | k (md) | ϕ | kh | ϕh | F | C |
|---|---|---|---|---|---|---|
| | | | | | 0 | 0 |
| 5 | 500 | 0.25 | 2500 | 1.25 | 0.7564 | 0.333 |
| 5 | 100 | 0.2 | 500 | 1 | 0.9077 | 0.6 |
| 5 | 50 | 0.15 | 250 | 0.75 | 0.9834 | 0.8 |
| 5 | 10 | 0.1 | 50 | 0.5 | 0.9985 | 0.933 |
| 5 | 1 | 0.05 | 5 | 0.25 | 1 | 1 |
| | | Σ | 3305 | 3.75 | | |

The resulting F-C curve for this example is given in FIG. 1. Calculating the F-C curve from static data or by assuming a simple flow geometry, as we have in the present example, is relatively straightforward. However, this analysis does not take into account the possibility of a variable flow path length, which is common in heterogeneous media. Measures of static heterogeneity are unable to capture how fluid flow is impacted by connectivity between a production well and a fluid injection well. For example, a low permeability, short path typically cannot be differentiated from a high permeability, long path because both flow paths have a similar residence time.

Therefore, while measures of static heterogeneity can be analyzed to describe some aspects of heterogeneity, they cannot describe how "connected" that heterogeneity is. Furthermore, differences in each model's recovery behavior is not quantitatively obtained. For example, there is no guarantee that varying the permeability variance of an earth model will result in changes to the recovery efficiency, which can be described as the percentage of oil recovered. Similarly, this change also will not indicate how the sweep efficiency, which can be described as the percentage of oil recovery verses time, will be impacted. Therefore, while simulation of earth models provides for prediction of reservoir performance, it does not allow for rapid evaluation of how particular earth model characteristics influence the predicted performance. Moreover, there is no present method of evaluating the dynamic heterogeneity of an earth model to unambiguously rank it against other earth models.

SUMMARY OF THE INVENTION

According to an aspect of the present invention, a computer-implemented method is disclosed for determining the dynamic heterogeneity of a subsurface reservoir. The method includes providing an earth model representing a subsurface reservoir. Streamline analysis is performed to identify streamlines indicative of flow geometry within the earth model. Flow and storage capacity are determined for the earth model responsive to the streamline analysis. Dynamic heterogeneity for the earth model is calculated responsive to the flow and storage capacity and is then displayed.

In one or more embodiments, multiple earth models representing the subsurface reservoir are provided such that streamline analysis is performed, flow and storage capacity are determined, and dynamic heterogeneity is calculated and displayed for the earth models. In one or more embodiments, the earth models are ranked responsive to a production performance metric such as a discounted oil rate, an ultimate hydrocarbon recovery, or a net present value.

In one or more embodiments, a curve comparing flow capacity against storage capacity is assembled. In one or more embodiments, the curve comparing flow capacity against storage capacity is assembled by ordering streamlines indicative of flow geometry within the earth model according to increasing residence time.

In one or more embodiments, the flow capacity of the earth model is determined by calculating a volumetric flow for each of the streamlines indicative of flow geometry within the earth model.

In one or more embodiments, the storage capacity of the earth model is determined by calculating a pore volume for each of the streamlines indicative of flow geometry within the earth model. In one or more embodiments, the pore volume for each of the streamlines is determined by calculating a time of flight and a volumetric flow rate of the streamline.

In one or more embodiments, dynamic heterogeneity for the earth model is calculated as a Lorenz Coefficient, a Flow Heterogeneity Index, a sweep efficiency at about one pore volume injected, or a fraction of streamlines broken through at about 0.5 pore volumes injected.

In one or more embodiments, dynamic heterogeneity for the earth model is determined responsive to a tracer test.

In one or more embodiments, dynamic heterogeneity for the earth model is used to determine how altering static properties of the earth model influence a predicted production performance of the subterranean reservoir.

Another aspect of the present invention includes a computer-implemented method for determining a dynamic heterogeneity of a subsurface reservoir. Reservoir models that represent a subsurface reservoir are provided and streamlines indicative of flow geometry within the subsurface reservoir are identified for each of the reservoir models. A flow and storage capacity curve is constructed for each of the reservoir models by ordering the streamlines for each of the reservoir models according to increasing residence time. Dynamic heterogeneity for each of the reservoir models is calculated responsive to the flow and storage capacity curve for each of the reservoir models. Dynamic heterogeneity for the reservoir models is displayed to rank the reservoir models responsive to a production performance metric.

In one or more embodiments, dynamic heterogeneity for the earth models are calculated as a Lorenz Coefficient, a Flow Heterogeneity Index, a sweep efficiency at about one pore volume injected, or a fraction of streamlines broken through at about 0.5 pore volumes injected.

In one or more embodiments, the streamlines indicative of flow geometry within the subsurface reservoir are identified responsive to a tracer test.

In one or more embodiments, the production performance metric is a discounted oil rate, an ultimate hydrocarbon recovery, or a net present value.

Another aspect of the present invention includes a computer-implemented method for determining the dynamic heterogeneity of a subsurface reservoir. The method includes providing an earth model representing a subsurface reservoir. Streamlines indicative of flow geometry within the earth model are identified. Flow and storage capacity are determined for the earth model responsive to the streamlines. A Lorenz Coefficient for the earth model is calculated responsive to the flow and storage capacity and is then displayed.

In one or more embodiments, the Lorenz Coefficient for the earth model is plotted versus a production performance metric such as a discounted oil rate, an ultimate hydrocarbon recovery, or a net present value.

BRIEF DESCRIPTION OF THE DRAWINGS

FIG. 10 shows a computation used to calculate the dynamic Lorenz Coefficient from static properties, in accordance with an aspect of the present invention.

DETAILED DESCRIPTION OF THE INVENTION

Figure 1:
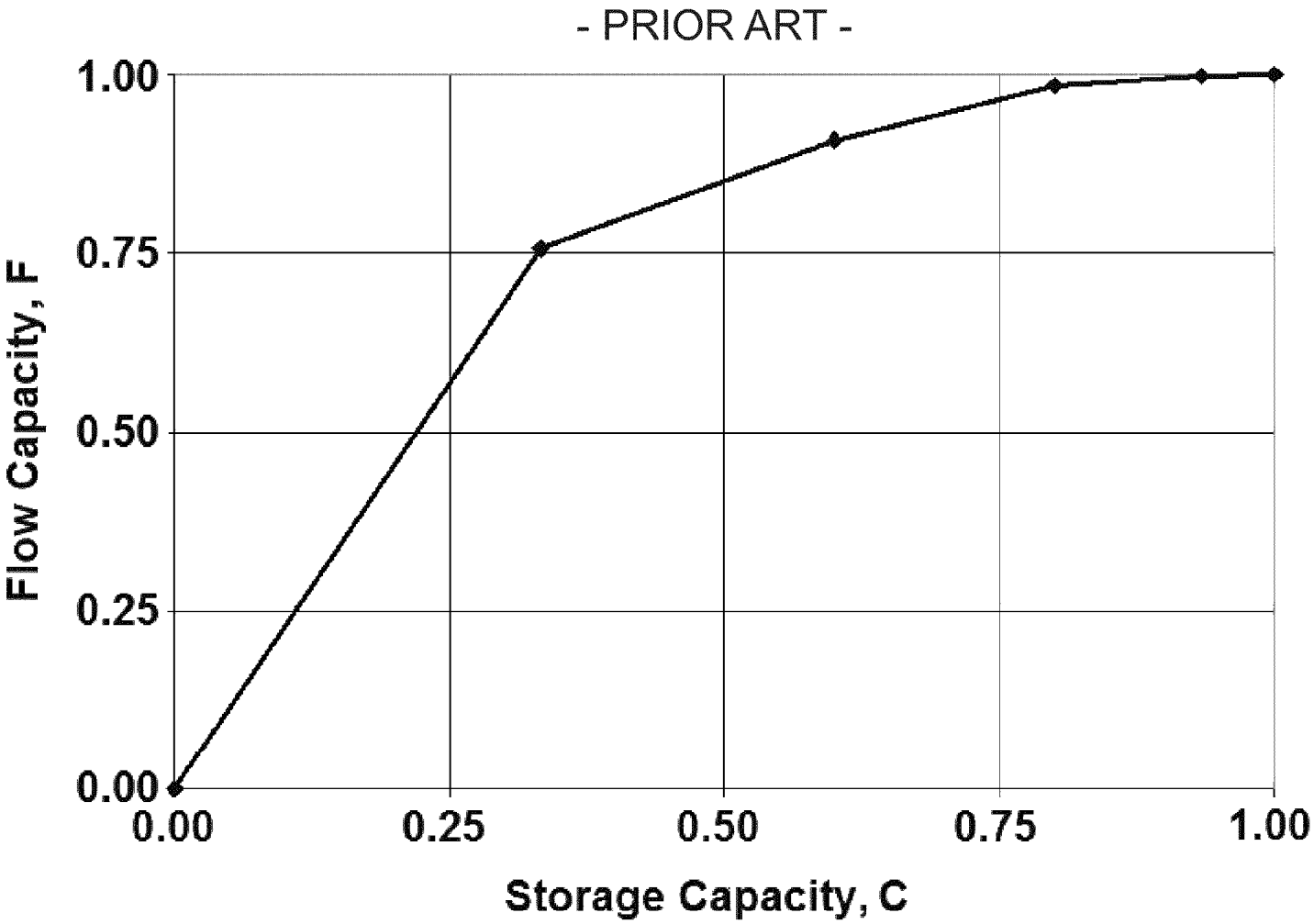
FIG. 1 is a graph of a flow capacity-storage capacity curve for a 5 layer model.
Figure 2:
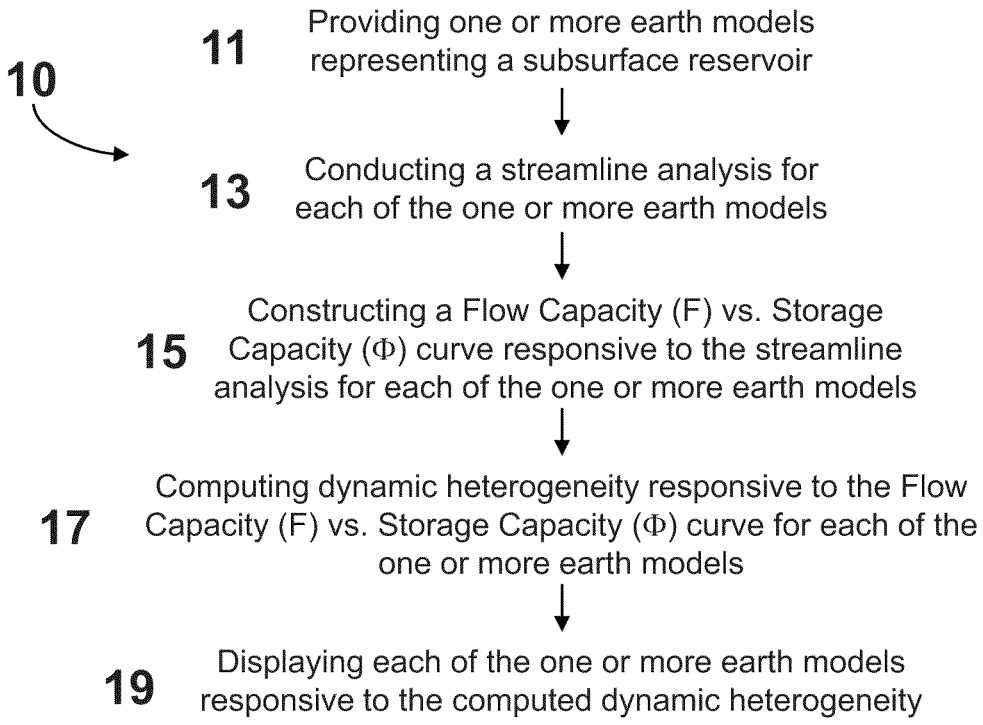
FIG. 2 is a flowchart illustrating steps of a method used to evaluate reservoir models based on dynamic heterogeneity, in accordance with an aspect of the present invention.

FIG. 2 illustrates method 10 to evaluate reservoir models based on dynamic heterogeneity, in accordance with an aspect of the present invention. In particular, steps are employed to rank earth models based on a measure of dynamic heterogeneity. One or more earth models representing a subsurface reservoir are provided in Step 11 of method 10. Streamline analysis for the one or more earth models is conducted in Step 13. Flow Capacity (F) vs. Storage Capacity (Φ) curves are constructed for each of the earth models in Step 15. The Flow Capacity (F) vs. Storage Capacity (Φ) curves are the dynamic counterparts to the static F-C curves, and are calculated based on the streamline analysis performed in Step 13. Dynamic heterogeneity for each of the one or more earth models is computed in Step 17. The dynamic heterogeneity is computed from the Flow Capacity (F) vs. Storage Capacity (Φ) curves constructed for each of the earth models in Step 15. The earth models are displayed and can be ranked responsive to the measure of dynamic heterogeneity in Step 19. For example, dynamic heterogeneity can be displayed via printing, a display screen or on a data storage device. Additionally, dynamic heterogeneity can be visually displayed using a computer monitor or user interface device such as a handheld graphic user interface (GUI) including a personal digital assistant (PDA).

The plurality of earth models, such as those provided in Step 11 of method 10, provide numerical representations of the subsurface reservoir. The plurality of earth models is generated to capture the geological uncertainty in the spatial distributions of reservoir properties. Streamline simulation can be performed for the earth models to evaluate the geological uncertainty of the subsurface reservoir and the dynamic heterogeneity in the earth models. Streamline models solve for fluid pressures on a grid and construct streamlines to describe flow geometry between sources and sinks. Streamlines are constructed such that they are normal to the pressure field. Furthermore, streamlines can take any arbitrary shape as they are not constructed along a finite difference grid.

By modeling the fluid flow within the reservoir along streamlines, the distribution of flow paths within complex geology can be resolved. The fluid flow behavior can also be visually depicted to better understand the geology and flow paths of the subsurface reservoir. There are many commercially available products for performing 3D streamline simulation such as FrontSim™ from Schlumberger Limited, which is headquartered in Houston, Tex.

Streamline simulation is performed for compressible fluids by solving the pressure equation at various times during the simulation. However, multiple pressure solutions are calculated if displacement forces are not balanced. For example, if the mobility ratio is not unity or buoyancy forces are significant then multiple pressure solutions can be computed. In these cases, the distribution in streamlines is not at steady state and therefore, varies in time. This causes ambiguity in describing heterogeneity, since intuitively heterogeneity is a property of the reservoir model and not the displacement mechanism.

In one or more embodiments of the present invention, it is therefore desirable to have conditions of constant compressibility, single phase flow, a mobility ratio of one, and no density differences while performing streamline simulation. Constant or small compressibility is typically easier to solve numerically than incompressible flow. Additionally, transients associated with compressible fluids can be attenuated very rapidly during streamline simulation. For example, simulation can be performed for a few time steps to attenuate pressure transients. Single phase flow precludes capillary forces from interacting with heterogeneity. With no viscous or buoyancy imbalances, the flow geometry can rapidly be evaluated. Thus, given these conditions, the analysis describes the heterogeneity itself and not its interaction with body forces.

The output from streamline simulation is analyzed in Step 13 of method 10. Analysis of the steamline models includes computing flow geometry using the "time of flight" (TOF) of the streamlines, $\tau_i$, and their volumetric flow rate, $q_i$. The "time of flight" (TOF) of the streamlines is the time required for a volume of fluid to move from the start of a streamline, which is at the injector well, to the end of a streamline, which is at the production well. From this analysis, flow geometry and sweep efficiency of a given model can be estimated.

Flow Capacity (F) vs. Storage Capacity (Φ) curves are constructed in Step 15 of Method 10 using streamlines. As will be described in more detail herein, Flow Capacity (F) vs. Storage Capacity (Φ) curves that are derived from streamline simulation can be considered as a dynamic estimate of heterogeneity. A streamline simulator can be operated a few time steps so pressure transients are attenuated and the simulation is at steady state. The volumetric flow rate and "time of flight" output, which were obtained from streamline analysis in Step 13 of method 10, are used to calculate the individual streamlines' pore volume. The pore volume of the $i^{th}$ streamline is determined by:

$$Vp_i = q_i \tau_i \quad \text{(Equation 5)}$$

where $Vp_i$ is the pore volume, $q_i$ is the volumetric flow rate assigned to the streamline, and $\tau_i$ is the time of flight (TOF). The streamlines are ordered according to increasing residence time, such that they are arranged with a decreasing value of q/Vp. The flow capacity (F) and storage capacity (Φ) is calculated and plotted using the following:

$$F_i = \frac{\sum_{j=1}^{i} q_j}{\sum_{j=1}^{N} q_i} \text{ and } \Phi_i = \frac{\sum_{j=1}^{i} Vp_j}{\sum_{j=1}^{N} Vp_j} \quad \text{(Equation 6)}$$

Figure 3:
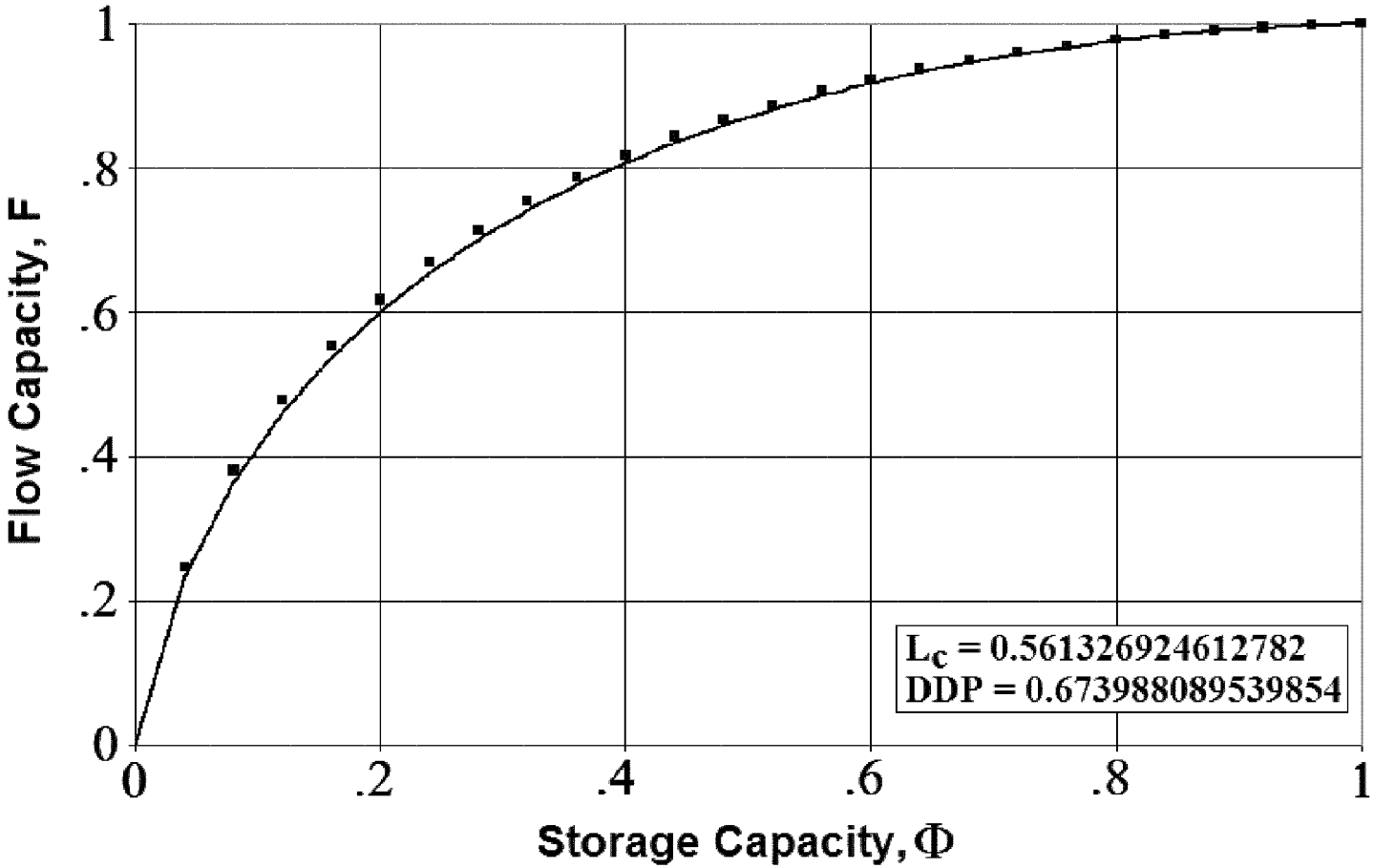
FIG. 3 is a graph comparing a flow capacity-storage capacity curve calculated from streamline analysis to a flow capacity-storage capacity curve calculated analytically from static data, in accordance with an aspect of the present invention.

FIG. 3 shows an example comparing a streamline-derived F-Φ curve to the static analytical calculation using Equations 1-4 from input values of permeability, porosity, and layer thickness. The analytic calculation of F-Φ is shown in symbols, while the solid line depicts the F-Φ curve obtained from streamline behavior. In this example, the streamlines are parallel, so all flowpath lengths are equal, and streamline "time of flight" is proportional only to k/ϕ. Due to this, the F-Φ curve derived from streamline simulation, which can be considered a dynamic estimate, agrees with the static calculation. However, typically streamlines have arbitrary or nonuniform length, so the streamline "time of flight" is proportional to both k/ϕ and streamline length. Accordingly, dynamic Flow Capacity (F) vs. Storage Capacity (Φ) curves typically cannot be inferred a priori from static data.

As described in Step 17 of Method 10, a measure of dynamic heterogeneity responsive to the Flow Capacity (F) vs. Storage Capacity (Φ) curve is computed for each of the plurality of earth models. Dynamic measures of heterogeneity take into account flow geometry within a subsurface reservoir such as a variable flow path length, which is common in heterogeneous media. During secondary recovery of a reservoir, fluid such as water, chemicals, gas, or a combination thereof, is injected into the reservoir to maintain reservoir pressure and displace hydrocarbons toward the production well. Fluid flow within the subsurface reservoir can greatly be impacted depending on the connectivity between the production well and the fluid injection well. Dynamic measures of heterogeneity can be estimated directly from a tracer test or streamline residence times, as these methods account for flow geometry within a subsurface reservoir.

To compute the measure of dynamic heterogeneity for each earth model, a Dynamic Heterogeneity Index (DHI) is utilized. The Dynamic Heterogeneity Index is constructed so that model performance is sensitive to the Dynamic Heterogeneity Index. For example, a change in the Dynamic Heterogeneity Index should correspond to a measurable change in the production behavior of the earth model. Additionally, the relationship between the Dynamic Heterogeneity Index and the production behavior of the model should be unique, so that a reported change in the Dynamic Heterogeneity Index can be interpreted as a known change in production performance Finally, the Dynamic Heterogeneity Index should be a meaningful measure of some property of the model that can be readily identified and measured.

One example of a Dynamic Heterogeneity Index is the Lorenz coefficient, Lc. The Lorenz coefficient is defined as $$L_C = 2\left(\int_0^1 F d\Phi - 0.5\right) \quad \text{(Equation 7)}$$

Figure 4:
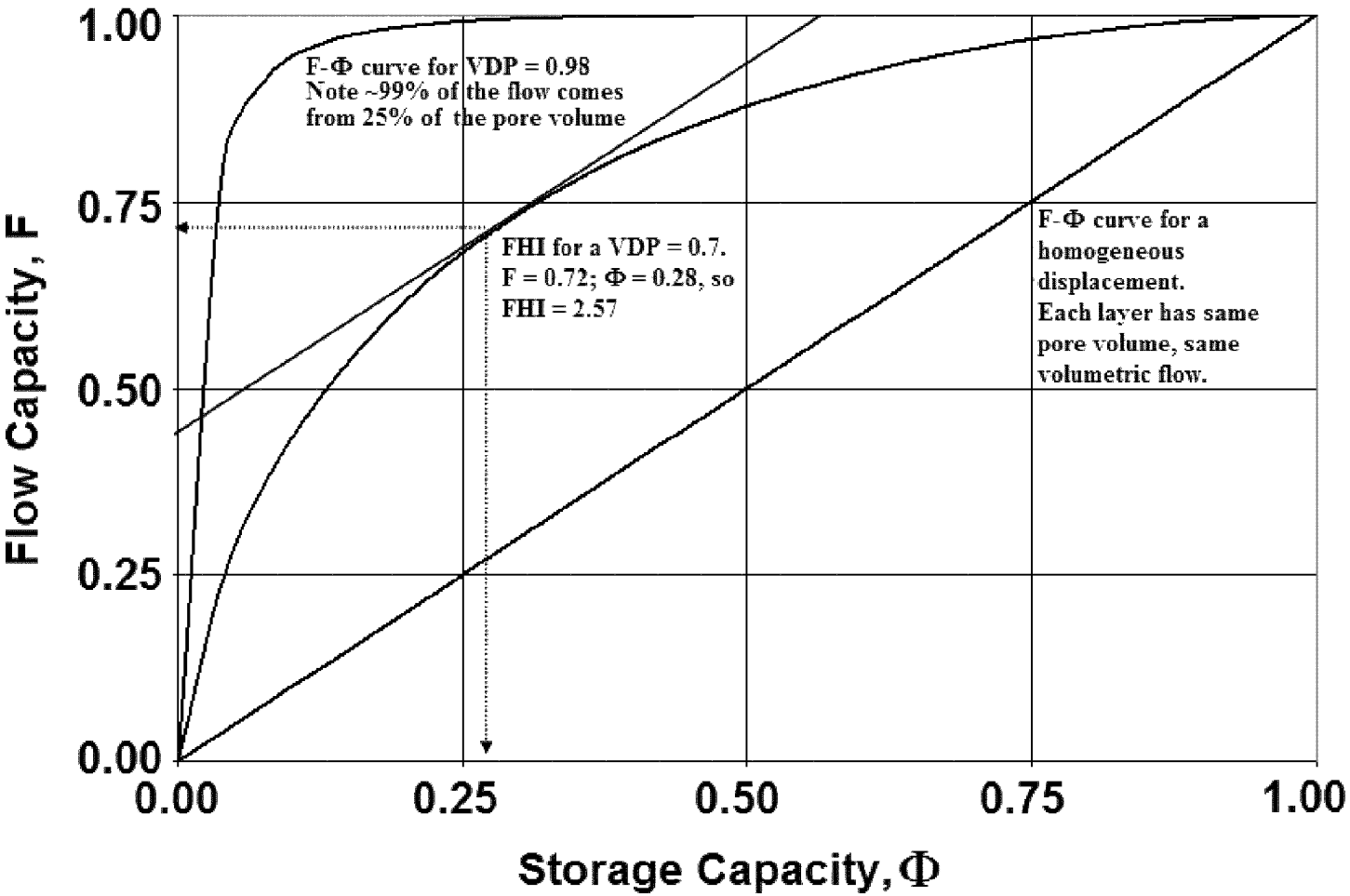
FIG. 4 is a graph showing how the Flow Heterogeneity Index, which is an example of a Dynamic Heterogeneity Index, can be calculated from flow capacity-storage capacity curves, in accordance with an aspect of the present invention.

A Lorenz coefficient of zero falls along the 45° line on the F-Φ curve that represents a homogeneous displacement. Therefore, if the Lorenz coefficient is zero, there is equal volumetric flow from every incremental pore volume. A Lorenz coefficient value of one is referred to as "infinitely heterogeneous," and can be interpreted as all of the flow coming from a very small portion of the pore volume. Schematically this is shown in FIG. 4.

Another example of a Dynamic Heterogeneity Index is the Flow Heterogeneity Index (FHI). The Flow Heterogeneity Index is the value of F/Φ on the flow capacity-storage capacity diagram where the tangent to the curve has unit slope. Therefore, $$FHI = \frac{F}{\Phi}\Big|_{m=1} \quad \text{(Equation 8)}$$

and the derivative of the F-Φ curve is $$\frac{dF}{d\Phi} = \frac{t^*}{\tau_i} \quad \text{(Equation 9)}$$

where t* is the mean residence time of all streamlines and τ is the "time of flight" of the $i^{th}$ streamline. The Flow Heterogeneity Index can therefore, be interpreted as representing flow vs. storage capacity of the domain. For homogeneous media, in which the Flow Heterogeneity Index is equal to one, the Flow Heterogeneity Index has no upper limit. The Flow Heterogeneity Index is also shown schematically in FIG. 4.

Another example of a Dynamic Heterogeneity Index is the Coefficient of Variation of the streamline "time of flight". The Coefficient of Variation is defined as $$C_V = \frac{\sqrt{\mathrm{Var}(\tau)}}{t^*} \quad \text{(Equation 10)}$$

where Var(τ) is the variance of the residence time distribution, which is the second temporal moment of the "time of flight" distribution, and t* is the mean residence time of all streamlines.

Several more examples of a Dynamic Heterogeneity Index are obtained from the sweep efficiency history. Sweep is defined as:

$$Ev(t) = \frac{\text{Volume of reservoir contacted by displacing agent at time } t}{\text{Total pore volume}} \quad \text{(Equation 12)}$$

A sweep efficiency history plot can be described as a second diagnostic plot that is readily obtained from F-Φ data. For example, swept volume as a function of time can be determined from the streamline time of flight distribution. Sweep efficiency can also be determined directly from F-Φ data using the equation:

$$E_V = \frac{q}{V_P}\int_0^{\tau}[1 - F(\tau)]d\tau \quad \text{(Equation 13A)}$$

Furthermore, sweep efficiency can be estimated graphically from a F-Φ diagram as:

$$E_V(t) = \Phi(t) + \frac{1 - F(t)}{dF/d\Phi} \quad \text{(Equation 13B)}$$

Using this procedure, the F-Φ curve can be interpreted as a generalized fractional flow curve, such that it describes displacements in 3-D.

Figure 5:
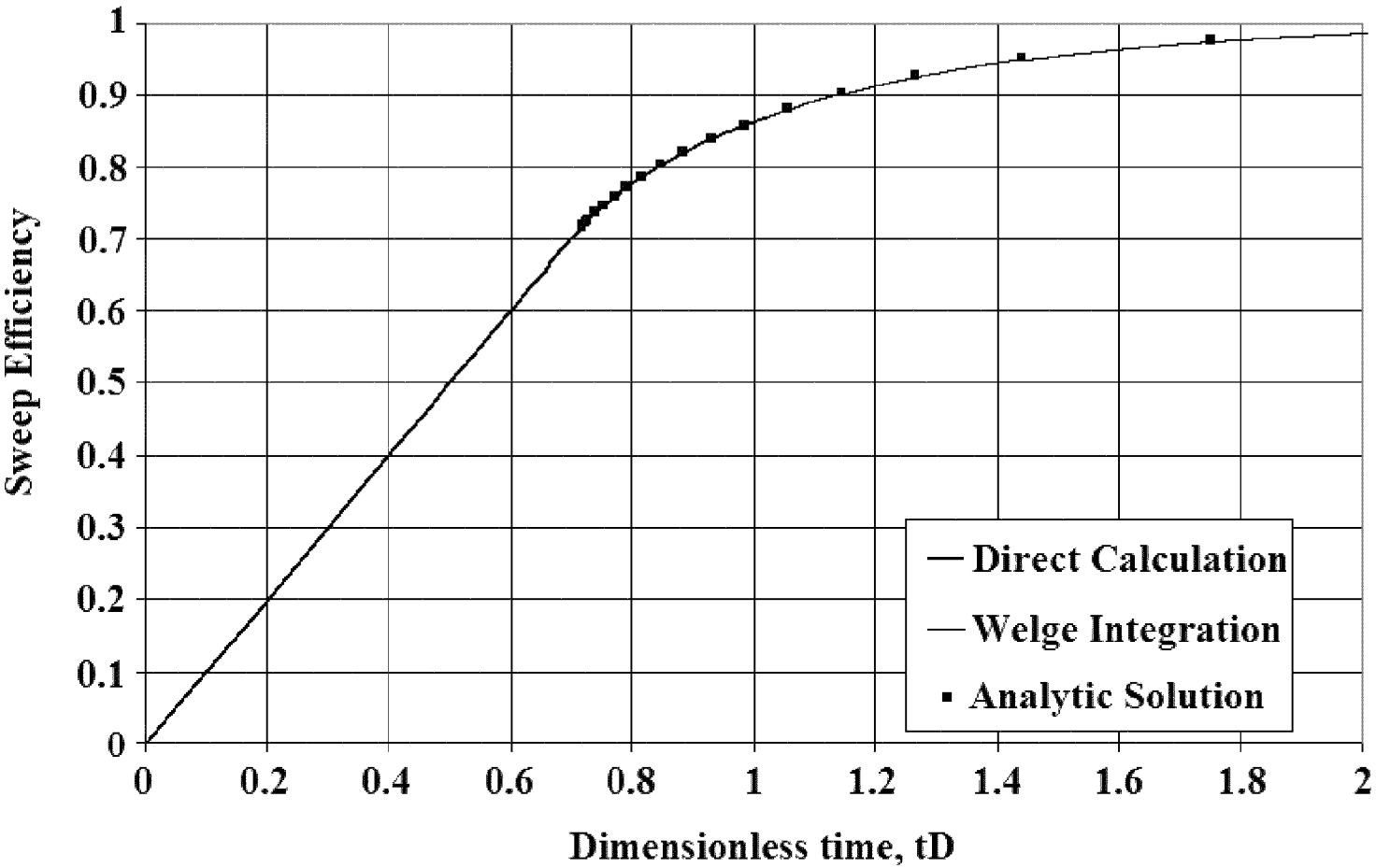
FIG. 5 is a graph of a sweep efficiency curve, in accordance with an aspect of the present invention.

FIG. 5 illustrates sweep efficiency for a homogeneous 5-spot well pattern estimated using various methods responsive to streamline data. The curves are indistinguishable, and agree well with the analytical solution to the problem.

One example of using sweep efficiency as the Dynamic Heterogeneity Index is to use the sweep efficiency at the mean residence time. Therefore, sweep efficiency is at one pore volume injected, or $t_D$=1. Another example of using sweep efficiency for the Dynamic Heterogeneity Index is to use the sweep efficiency at breakthrough.

Flow capacity, F, at fixed dimensionless time, $t_D$, can also be used as a Dynamic Heterogeneity Index. For example, in cases where the volumetric flow rate is equal among streamlines, such as in incompressible flow or at steady state, flow capacity can be interpreted as the fraction of streamlines that have broken through at any time. Therefore, flow capacity at 0.5 pore volumes injected is an example of a Dynamic Heterogeneity Index. Flow capacity at 1 pore volumes injected is another example of a Dynamic Heterogeneity Index.

These examples of Dynamic Heterogeneity Indices are measures of dynamic heterogeneity because they are developed from the Flow Capacity (F) vs. Storage Capacity (Φ) curve based on streamline simulation or dynamic data. Each example can be readily measured for a given simulation. A summary of these examples are below:

| Name | Formula | Description |
|---|---|---|
| $L_C$ | $L_C = 2\left(\int_0^1 F d\Phi - 0.5\right)$ | Standard statistical measure of CDFs; a measure of deviation from a homogeneous model |
| FHI | $FHI = \frac{F}{\Phi}\Big\|_{m=1}$ | The ratio of Flow-to-Storage where the F – Φ curve has unit slope (which is represented of mean bulk flow) |
| $C_V$ | $C_V = \frac{\sqrt{Var(\tau)}}{t^*}$ | Coefficient of variation, recognized as 'dimensionless variance' |
| $E_V$ at BT | | Sweep efficiency at breakthrough |
| $E_V$ at $t_D = 1$ | | Sweep efficiency at 1 pore volume injected |
| F at $t_D = 0.5$ | | Fraction of streamlines broken through at 0.5 pore volumes injected |
| F at $t_D = 1$ | | Fraction of streamlines broken through at 1 pore volume injected |

The Dynamic Heterogeneity Index can be, but is not limited to, one of these examples. A comparison of these examples for a plurality of earth models is provided in the Specification under the section labeled "Appendix." However, the comparison is presented only as an example, and is not intended to limit the scope of the Application or what can be utilized as a Dynamic Heterogeneity Index.

As described in Step 19 of Method 10, once a measure of dynamic heterogeneity is computed for each of the plurality of earth models, each of the plurality of earth models can be ranked according to a "response" to dynamic heterogeneity. For example, to rank earth models based on the Dynamic Heterogeneity Index, a production performance metric to compare the Dynamic Heterogeneity Index is needed. An example of a production performance metric is discounted oil rate. Discounted oil recovery provides an appropriate metric for production performance since "more heterogeneity" intuitively leads to detrimental reservoir performance. Other examples of a production performance metric include ultimate hydrocarbon recovery and net present value (NPV).

EXAMPLES

Method 10 is applied to eight earth models constructed for a subsurface reservoir, which are provided in Step 11 of Method 10. Streamline analysis for each of the eight earth models is conducted, as described in Step 13 of Method 10. Flow Capacity (F) vs. Storage Capacity (Φ) curves are constructed for each of the eight earth models based on the streamline analysis, as described in Step 15 of Method 10. The dynamic Lorenz coefficient is used as the Dynamic Heterogeneity Index (DHI) computed for the measure of dynamic heterogeneity, as described in Step 17 of Method 10. For this example, the primary recovery for each run was removed from the recovery history, as primary recovery is typically not a strong function of heterogeneity. Therefore, for this example a single primary recovery history was used to correct for primary depletion.

Discounted oil recovery was used as the performance metric to rank the Dynamic Heterogeneity Index for the measure of dynamic heterogeneity, as described in Step 19 of Method 10. To calculate discounted oil recovery, the oil recovery history for the reservoir was taken and the primary recovery was subtracted at each time step to obtain the discounted oil recovered to current time. The discounted oil recovered was normalized by a scaled-up reservoir model to report a dimensionless discounted oil recovery, which was then compared to the Dynamic Heterogeneity Index that was computed as the measure of dynamic heterogeneity in Step 17 of Method 10.

Figure 6:
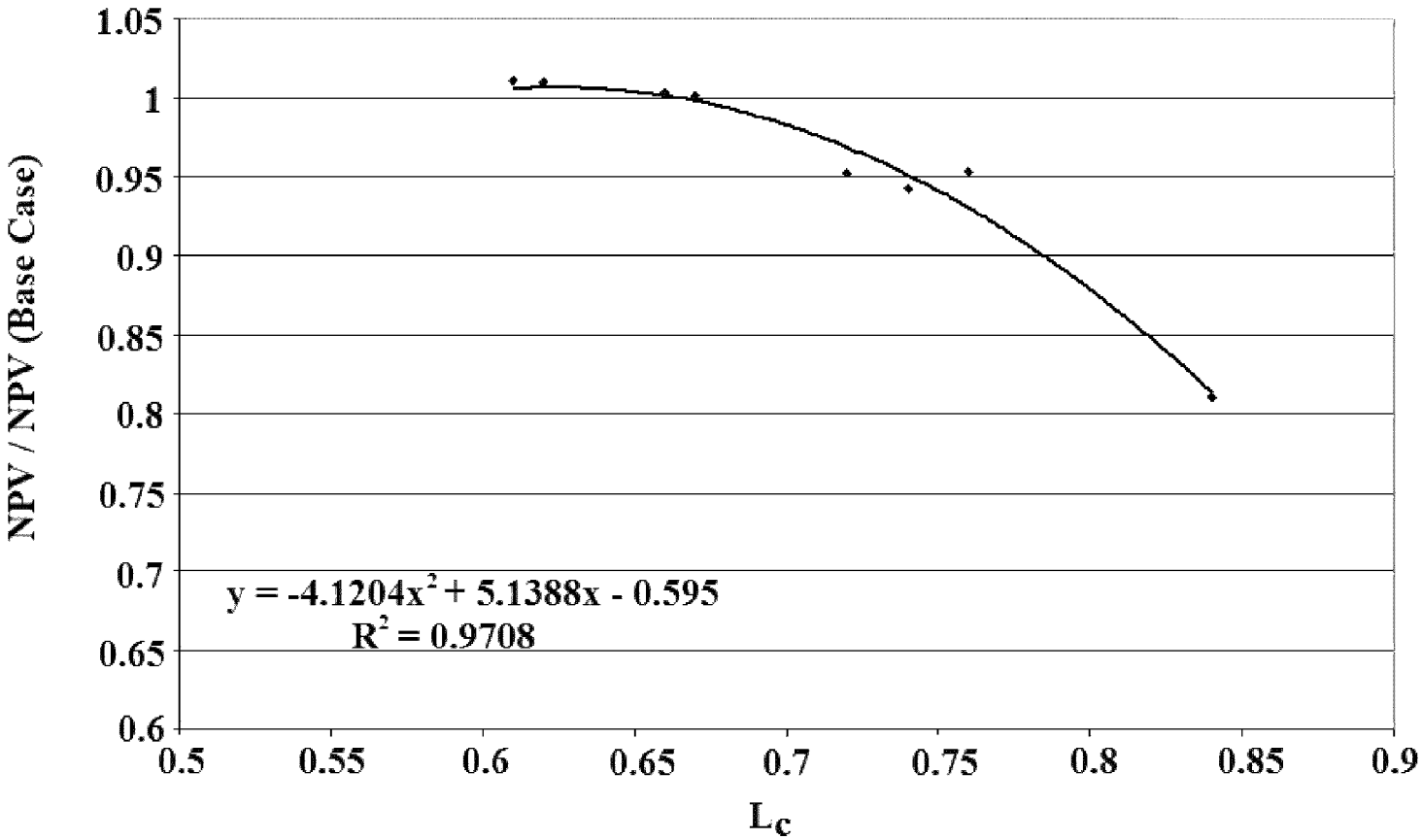
FIG. 6 is a graph ranking earth models responsive to the dynamic Lorenz Coefficient, in accordance with an aspect of the present invention.

The plot of net present value compared to the Dynamic Heterogeneity Index for the eight earth models is given in FIG. 6. The curve fit is also shown in the FIG. 6. While the curve fit is very good for field data, the error of the fit is mainly attributed to a single earth model. However, if that model is eliminated the correlation coefficient exceeds 0.99. Regardless of the fit, the Dynamic Heterogeneity Index ranks the earth models according to discounted oil recovery.

In one or more embodiments, the Dynamic Heterogeneity Index can be described in terms of the static properties used in populating an earth model. In particular, the Dynamic Heterogeneity Index can be written in terms of the static input properties by:

$$DHI = a \cdot V_{DP} + b \cdot \lambda_x + c \cdot \lambda_z + d \cdot R_L + \epsilon \quad \text{(Equation 14)}$$

where $V_{DP}$ is permeability variance, $\lambda_x$ and $\lambda_z$ are correlation lengths, $R_L$ is the effective aspect ratio, and ϵ represents the cross products of the static input properties. $R_L$ is defined as $$R_L = \frac{L}{H}\sqrt{\frac{k_v}{k_h}} \quad \text{(Equation 15)}$$

The values of constants (a, b, c, and d) can be estimated by fitting an expression for the Dynamic Heterogeneity Index given in Equation 14 to the values obtained for the Lorenz Coefficient, which is provided in the comparison presented in the Appendix, and then minimizing the square of the errors between the estimate and the observation.

Figure 7:
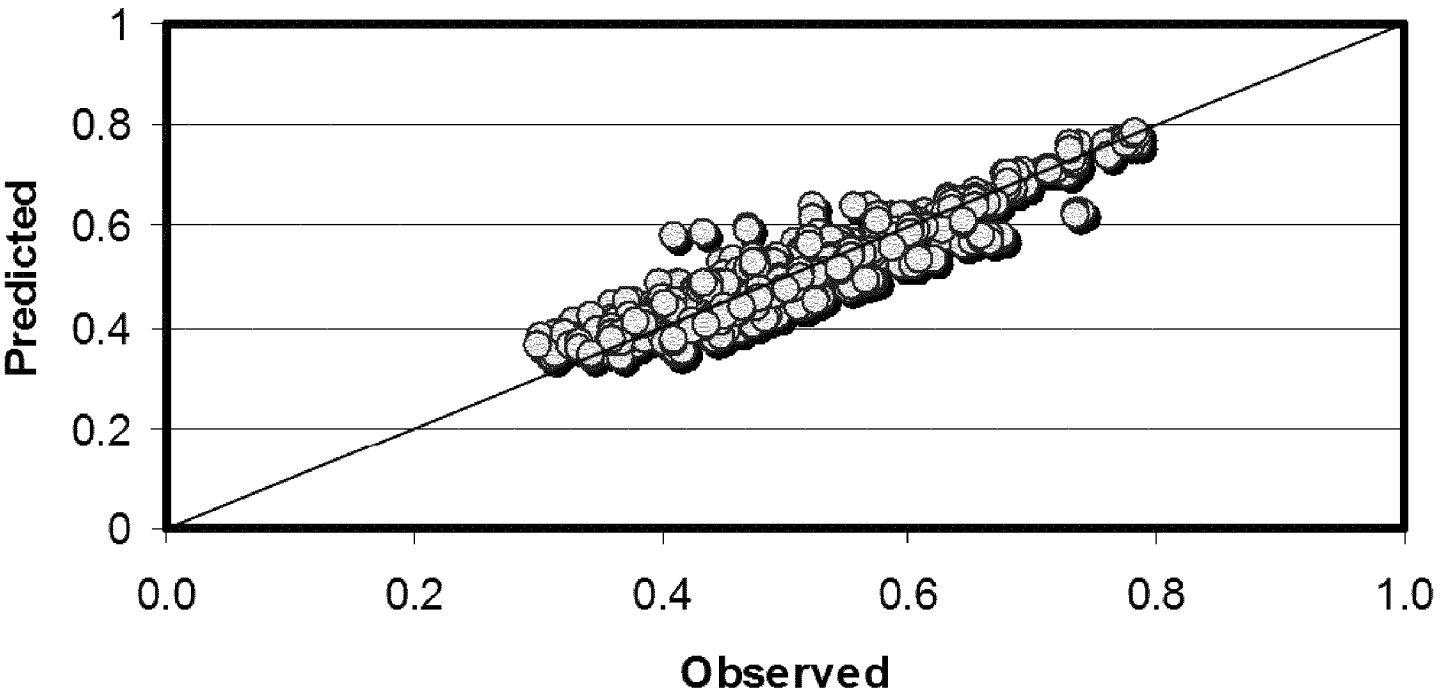
FIG. 7 shows the plot of Predicted Dynamic Heterogeneity Index vs. Observed Dynamic Heterogeneity Index for a 5-spot pattern and a line drive pattern, in accordance with an aspect of the present invention.

FIG. 7 shows the plot of Predicted DHI vs. Observed DHI for a 5-spot well pattern and a line drive well pattern. For the two well patterns combined into a single surface, the minimum error, which is the sum of the errors squared or $L_2$ norm, is 0.831. The average $L_2$ error for these 450 runs is 0.0011.

Figure 8:
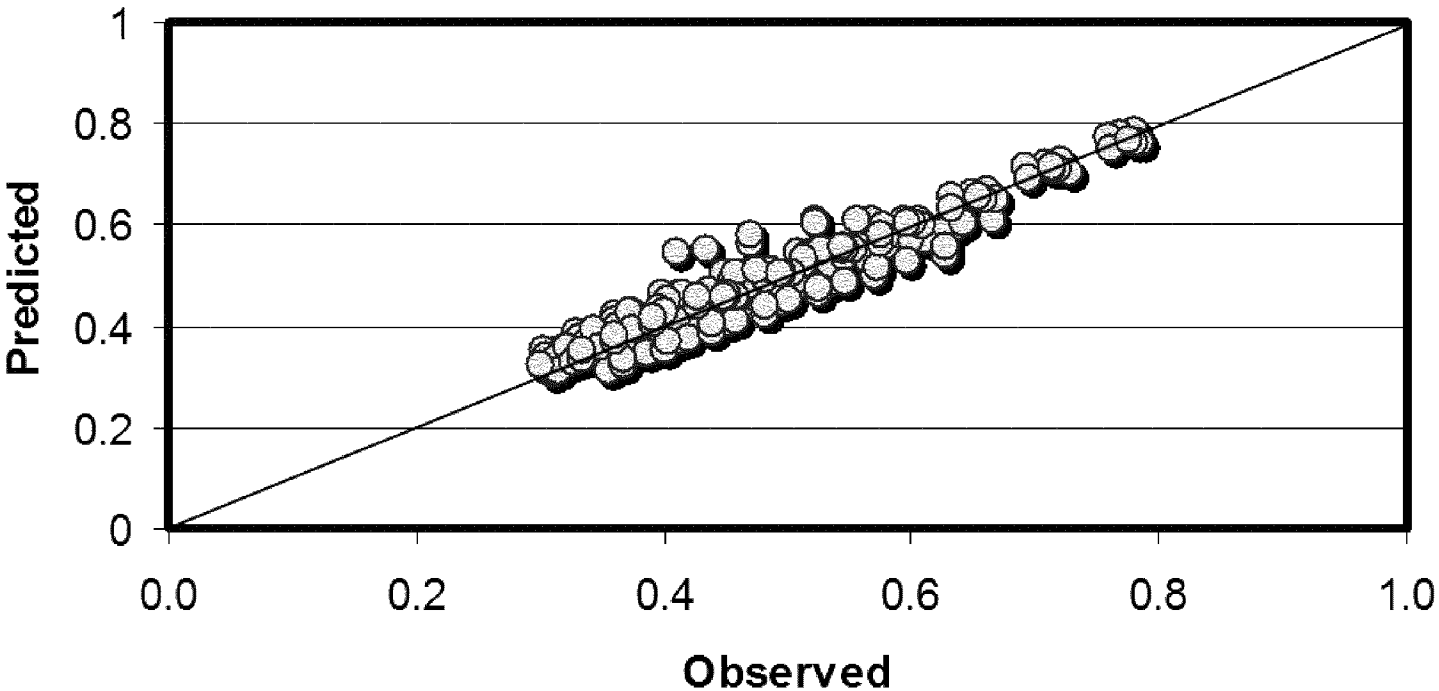
FIG. 8 is a graph of Predicted Dynamic Heterogeneity Index vs. Observed Dynamic Heterogeneity Index for a 5-spot pattern, in accordance with an aspect of the present invention.
Figure 9:
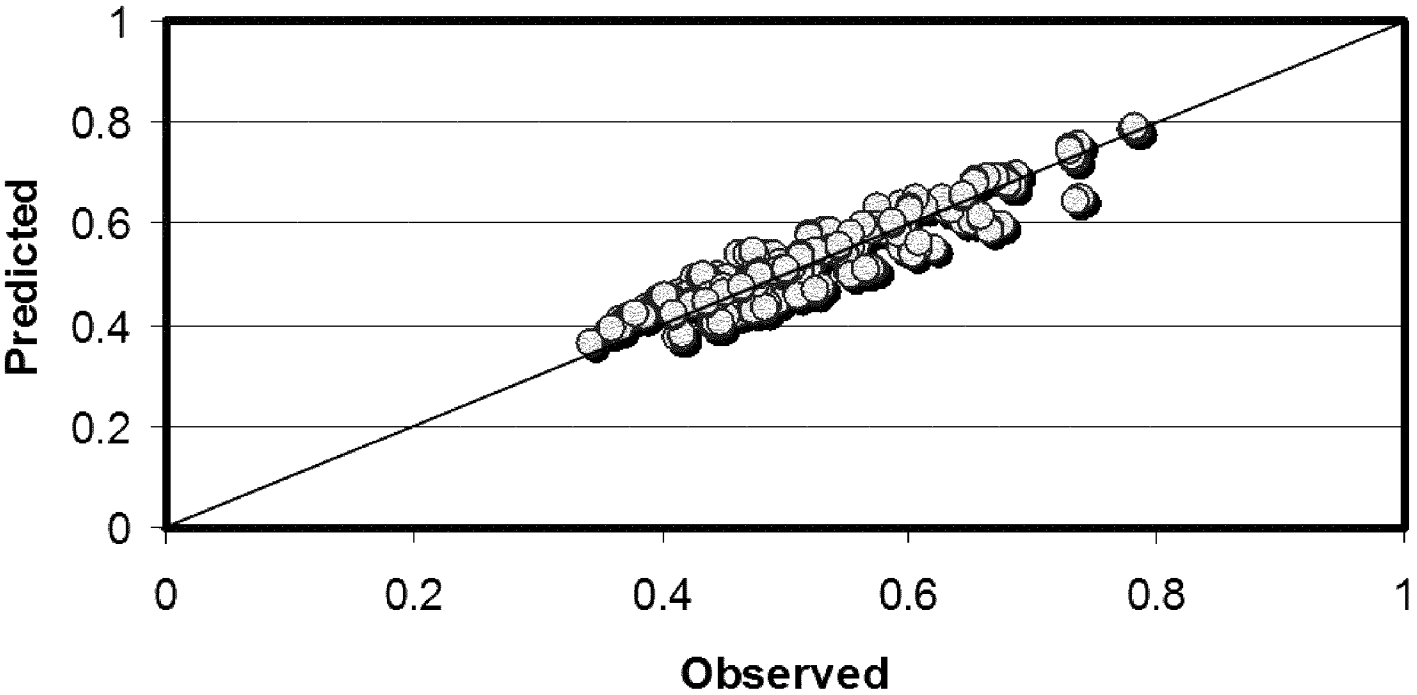
FIG. 9 is a graph of Predicted Dynamic Heterogeneity Index vs. Observed Dynamic Heterogeneity Index for a line drive pattern, in accordance with an aspect of the present invention.

FIGS. 8 and 9 show Predicted DHI vs. Observed DHI on these two well patterns separately. In particular, FIG. 8 shows Predicted DHI vs. Observed DHI for the 5-spot pattern and FIG. 9 shows Predicted DHI vs. Observed DHI for the line drive pattern. In this case, differences between predicted and observed DHI decreases. The $L_2$ norm is reduced to 0.249. Likewise, if the line drive pattern is considered separately, the $L_2$ norm is 0.312 and the average $L_2$ error is 0.0014. It appears there is a well geometry effect that is not captured adequately in Equation 14. It is equally possible that the simple combinations allowed during computation are not adequate to describe heterogeneity. Furthermore, other combinations of these properties might control displacement heterogeneity. For example, some nonlinear function of $V_{DP}*\lambda_X$ may actually control displacements.

FIG. 10 shows a computation that can be used to calculate the dynamic Lorenz Coefficient from static properties. This equation is sufficiently complex such that it does not lend itself to simple application.

Figure 11:
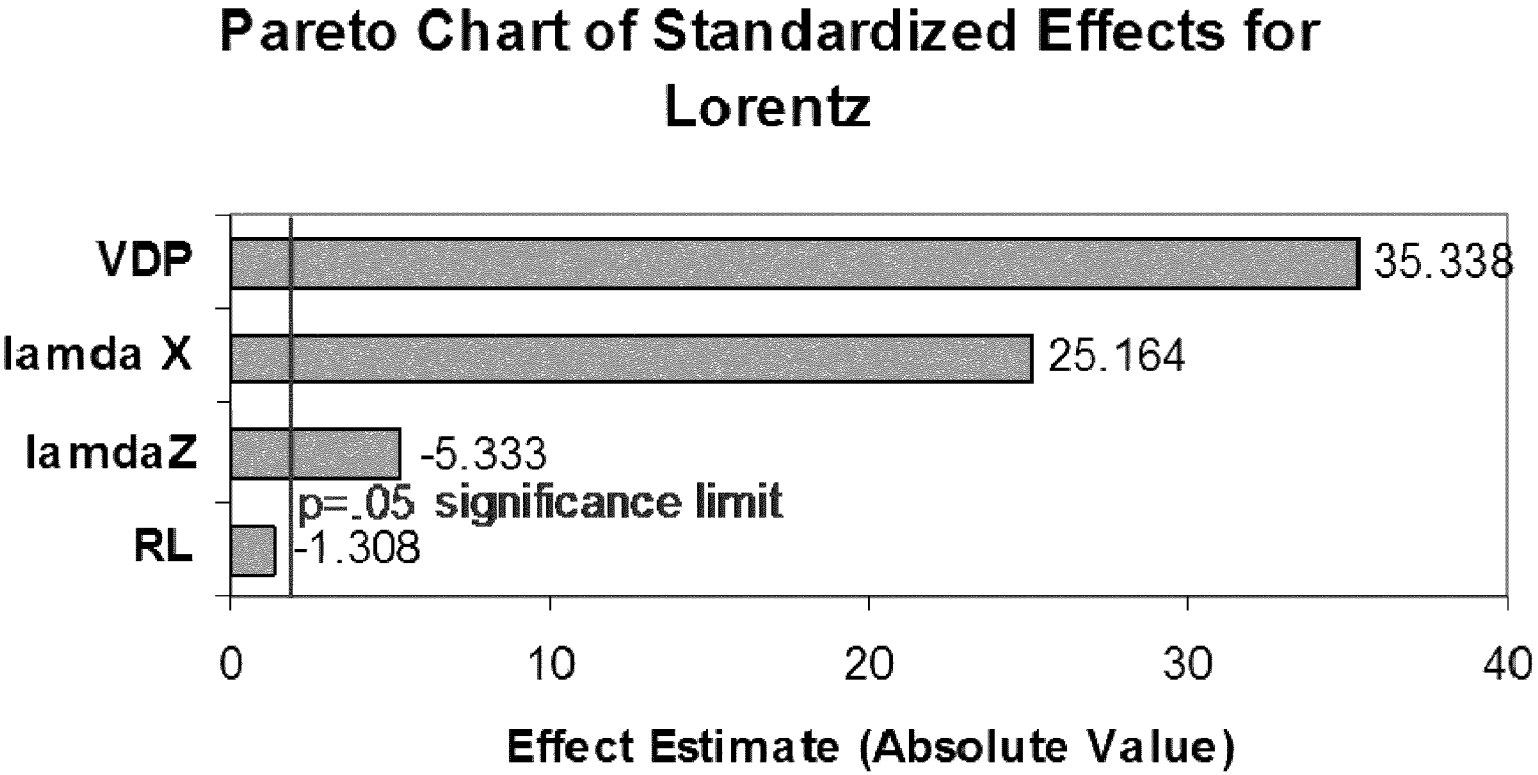
FIG. 11 is a Pareto Chart that was computed to show relative importance of static input properties on the Lorenz Coefficient, in accordance with an aspect of the present invention.

FIG. 11 is a Pareto Chart that was computed to show the relative importance of the input properties. The Pareto Chart illustrates the full 450 runs used in the study presented in the Appendix. The effective aspect ratio, $R_L$, which contains kv/kh, does not appear to significantly impact the prediction of the Dynamic Heterogeneity Index in this study.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention.

APPENDIX

The performance of the Dynamic Heterogeneity Indexes are compared on 450 synthetic models. In particular, they are compared for 225 different earth models for 2 well patterns. The synthetic models were constructed using Earth Decision Suite (powered by GOCAD™) distributed by Paradigm Geotechnology BV headquartered in Amsterdam, The Netherlands. The synthetic models were then exported to and simulated using Schlumberger's proprietary FrontSim™ 3D streamline simulator. All of the models are 20 acre square models, with a total thickness of 25 ft. Each earth model was constructed with a constant porosity so that all pore volumes are equal, as well as, a log-normal distribution in permeability.

The numerical model was built with an areal grid of 101×101 and 10 layers. Sequential Gaussian Simulation (SGS) was used to generate the permeability fields. To construct the models, the following inputs were used:

a. Mean of the field: a constant value of 100 and for all cases.
b. Standard deviation: For log-normal permeability fields, there is a 1:1 correspondence between the Dykstra-Parsons coefficient, $V_{DP}$, and standard deviation, so this is equivalent to fixing $V_{DP}$ for the models. The models were built with $V_{DP}$ varying between 0.6 and 0.9 by increments of 0.05. Therefore, 7 different static heterogeneity measures were used.
c. Horizontal correlation lengths: Horizontal correlation lengths used in the study were 66 ft., 660 ft., 2640 ft., and 33000 ft. For a quarter 5-spot, these lengths represent 0.05, 0.5, and 25 well spacings. The horizontal correlation length was assumed to be isotropic.
d. Vertical correlation lengths: Vertical correlation lengths were 2.5 ft. (0.01 reservoir thicknesses), and 12.5 ft. (0.5 thicknesses).

The above combinations constitute 56 different earth models. The cases were run with 4 ratios of vertical-to-horizontal permeability ($10^{-3}$, $10^{-2}$, 0.1, 0.5), which yields 224 heterogeneous models and a homogeneous model to make 225 models total. A quarter 5-spot pattern and a line-drive pattern were considered for each model, thus 450 sets of model runs are reported.

In this study, Discounted Oil Production is used as the performance metric to measure or rank the utility of the various examples for the Dynamic Heterogeneity Index. The injection/production rate is fixed, such that interstitial velocity for the 5-spot case is 0.3 ft/day. Incremental sweep efficiency, which was calculated each quarter year for the duration of the recovery history, was converted to oil recovered and discounted to present day using a discount rate of 10%. The single limiting case of perfect displacement was used in this study. That is, complete sweep and 100% oil recovery at 1.0 pore volumes injected. This results in Discounted Oil Recovery of 0.6321 for the injection and discount rates.

Figure 12:
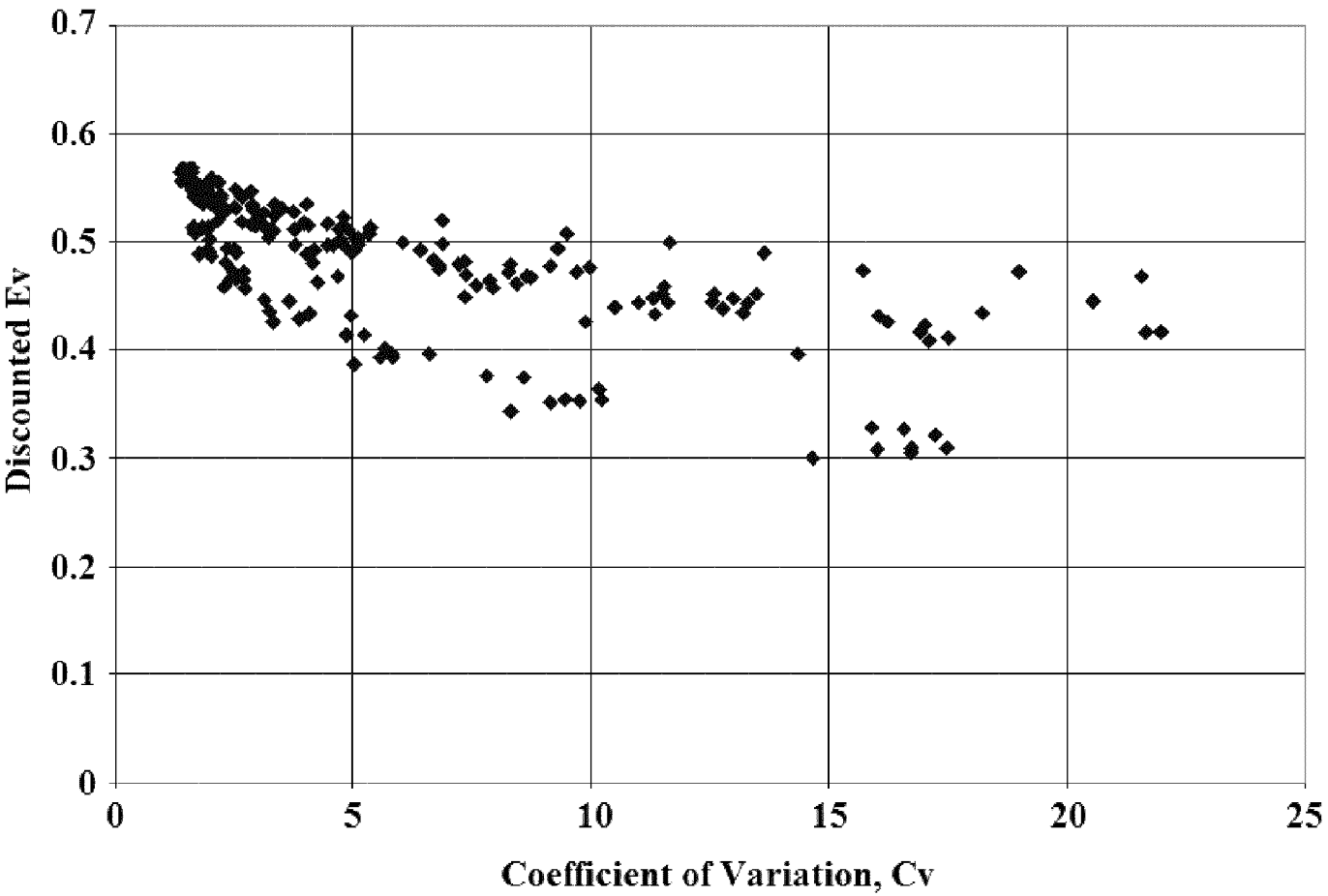
FIG. 12 is a graph of Discounted Oil Recovered vs. the Coefficient of Variation, Cv, for a 5-spot well pattern, in accordance with an aspect of the present invention.

FIG. 12 shows results of Discounted Oil Recovered vs. The Coefficient of Variation, Cv, for the 5-spot well pattern. The Coefficient of Variation has a large variation in this study. The curve in FIG. 12 consists of multiple individual curves corresponding to individual correlation lengths. Therefore, Cv does appear to account for differing correlation lengths uniquely in this study.

Figure 13:
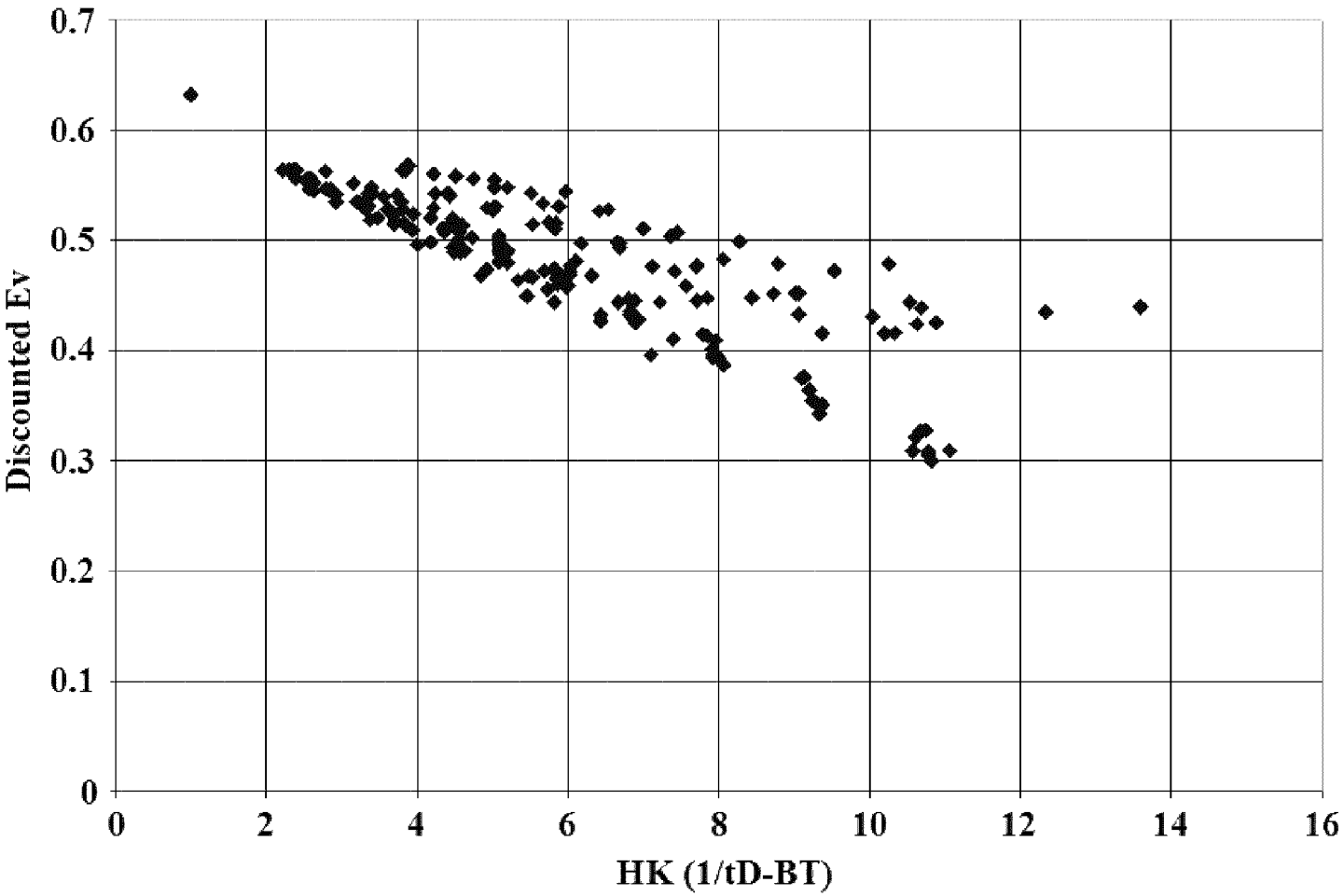
FIG. 13 is a graph of Discounted Oil Recovered vs. the Koval factor, for a 5-spot well pattern, in accordance with an aspect of the present invention.

FIG. 13 shows results of Discounted Oil Recovered vs. the sweep efficiency at breakthrough, for the 5-spot well pattern. The sweep efficiency at breakthrough has a large variation in this study. As in FIG. 12 where the Coefficient of Variation is illustrated, the sweep efficiency at breakthrough reveals a series of curves suggesting it does appear to account for differing correlation lengths uniquely in this study.

Figure 14:
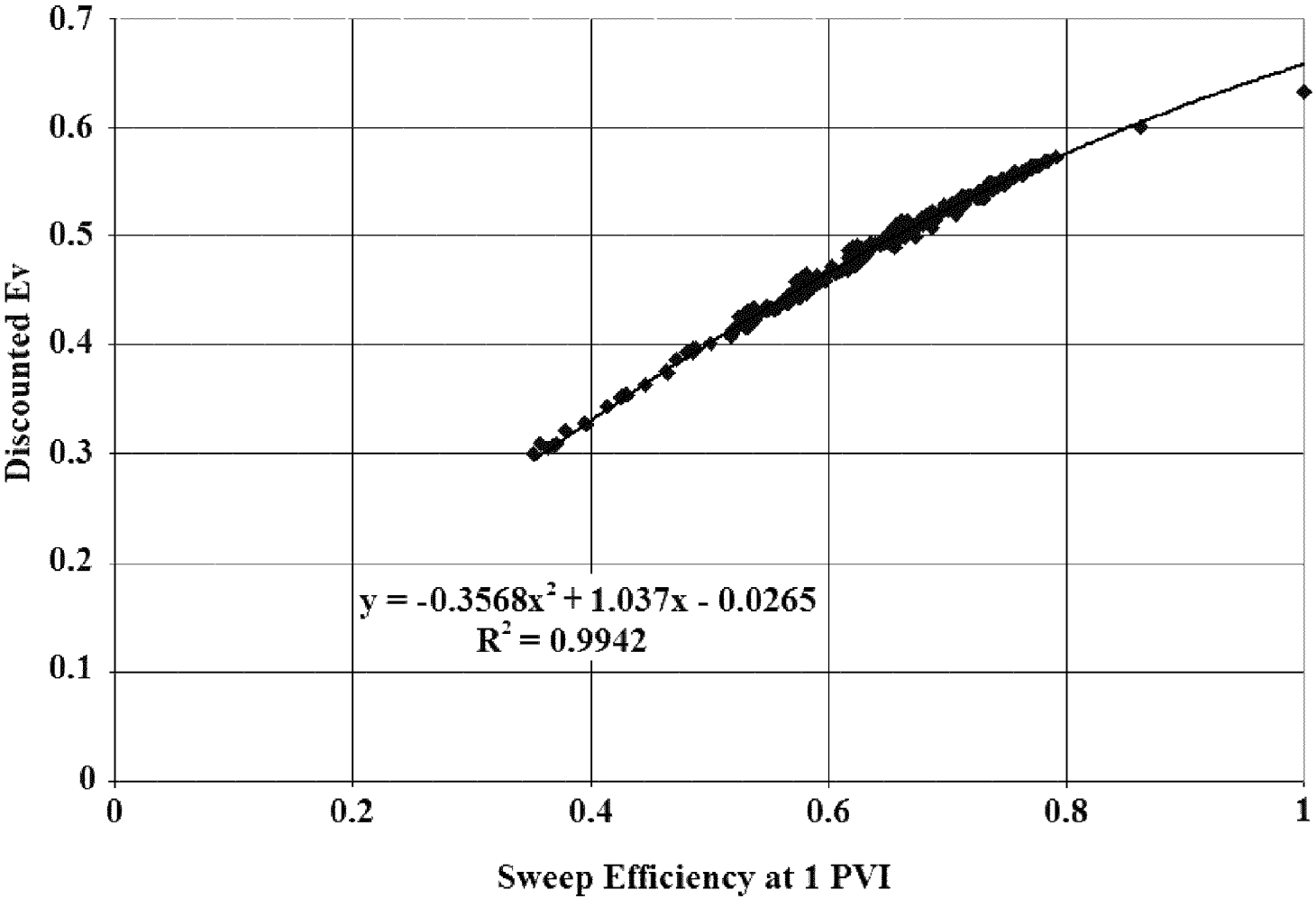
FIG. 14 is a graph of Discounted Oil Recovered vs. Sweep efficiency at 1 pore volume injected, $t_D$=1, for a 5-spot well pattern, in accordance with an aspect of the present invention.

FIG. 14 shows results of Discounted Oil Recovered vs. Sweep efficiency at 1 pore volume injected, $t_D$=1, for the 5-spot well pattern. Sweep efficiency at 1 pore volume injected appears to be an excellent indicator of dynamic heterogeneity in this study.

Figure 15:
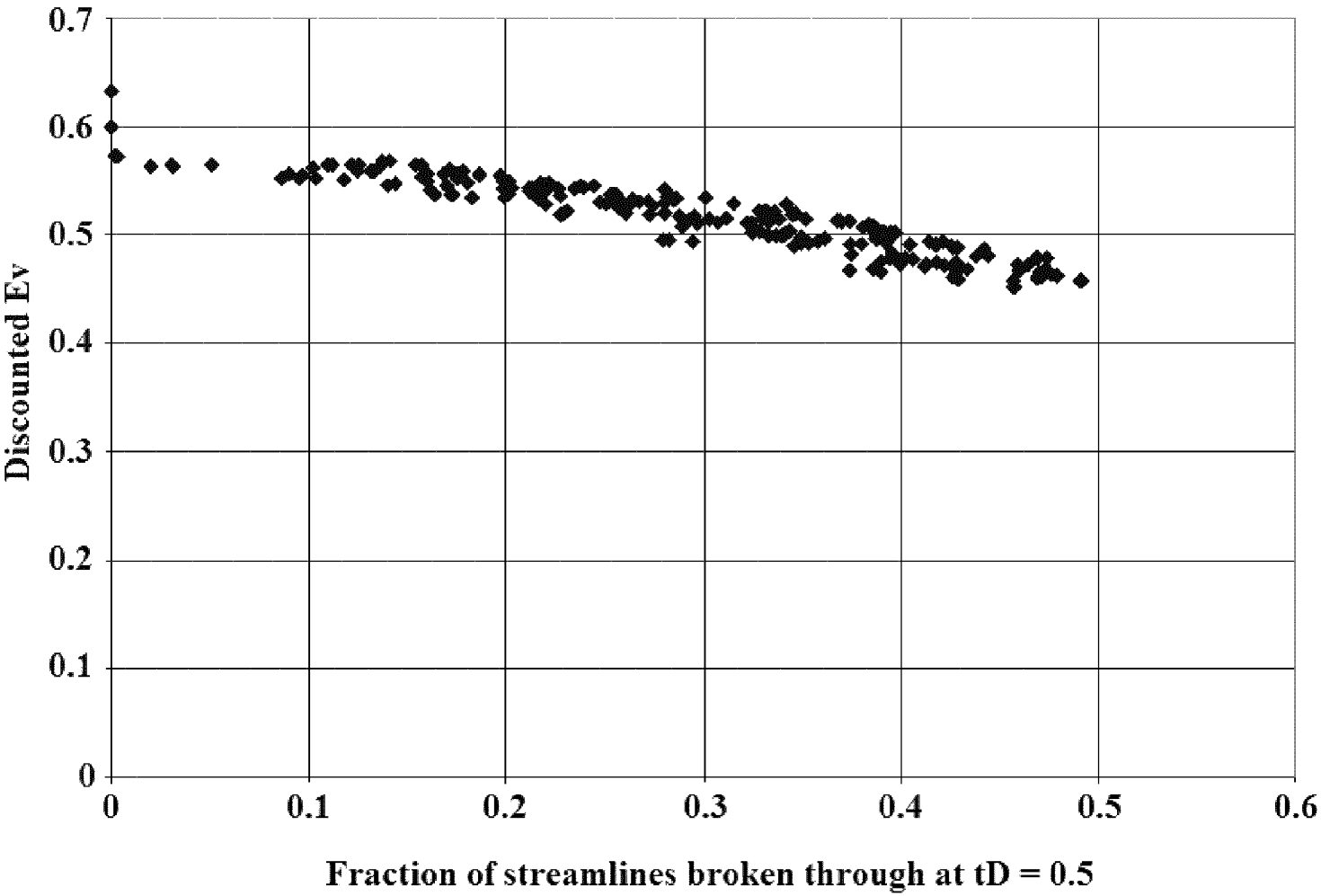
FIG. 15 is a graph of Discounted Oil Recovered vs. Fraction of streamlines broken through at 0.5 pore volumes injected, F at $t_D$=0.5, for a 5-spot well pattern, in accordance with an aspect of the present invention.

FIG. 15 shows results of Discounted Oil Recovered vs. Fraction of streamlines broken through at 0.5 pore volumes injected, F at $t_D$=0.5, for the 5-spot well pattern. The fraction of streamlines broken through at 0.5 pore volumes injected appears to be an excellent indicator of dynamic heterogeneity in this study. However, the curve does not approach the theoretical limit, as there are no streamlines broken through at 0.5 PVI for the perfect displacement case.

Figure 16:
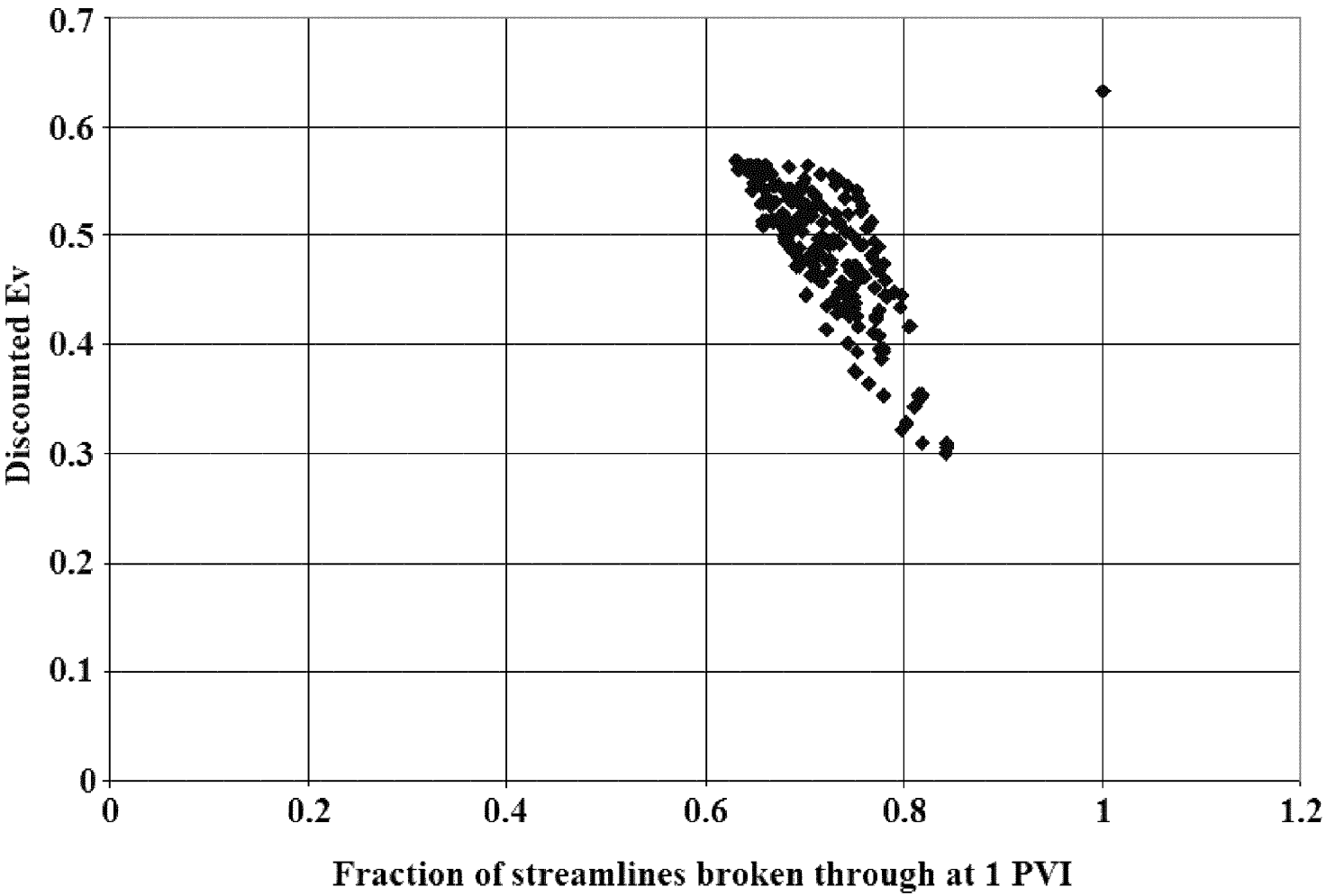
FIG. 16 is a graph of Discounted Oil Recovered vs. Fraction of streamlines broken through at one pore volumes injected, F at $t_D$=1, for a 5-spot well pattern, in accordance with an aspect of the present invention.

FIG. 16 shows results of Discounted Oil Recovered vs. Fraction of streamlines broken through at one pore volumes injected, F at $t_D$=1, for the 5-spot well pattern. The fraction of streamlines broken through at one pore volumes injected appears to be too late to be a good discriminator of heterogeneity in this study.

Figure 17:
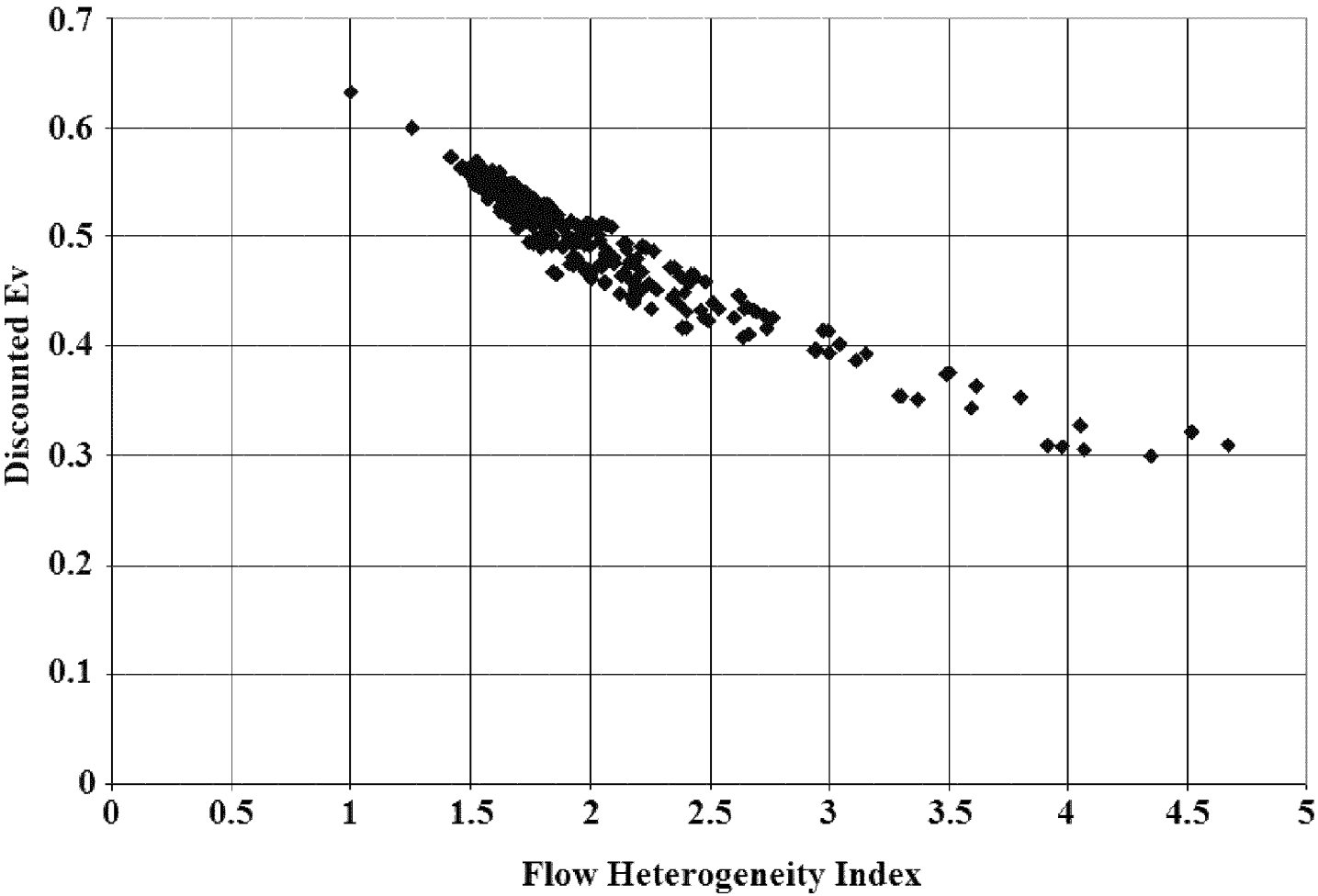
FIG. 17 is a graph of Discounted Oil Recovered vs. the Flow Heterogeneity Index, for a 5-spot well pattern, in accordance with an aspect of the present invention.

FIG. 17 shows results of Discounted Oil Recovered vs. the Flow Heterogeneity Index, for the 5-spot well pattern. The Flow Heterogeneity Index appears to be an excellent indicator of dynamic heterogeneity in this study.

Figure 18:
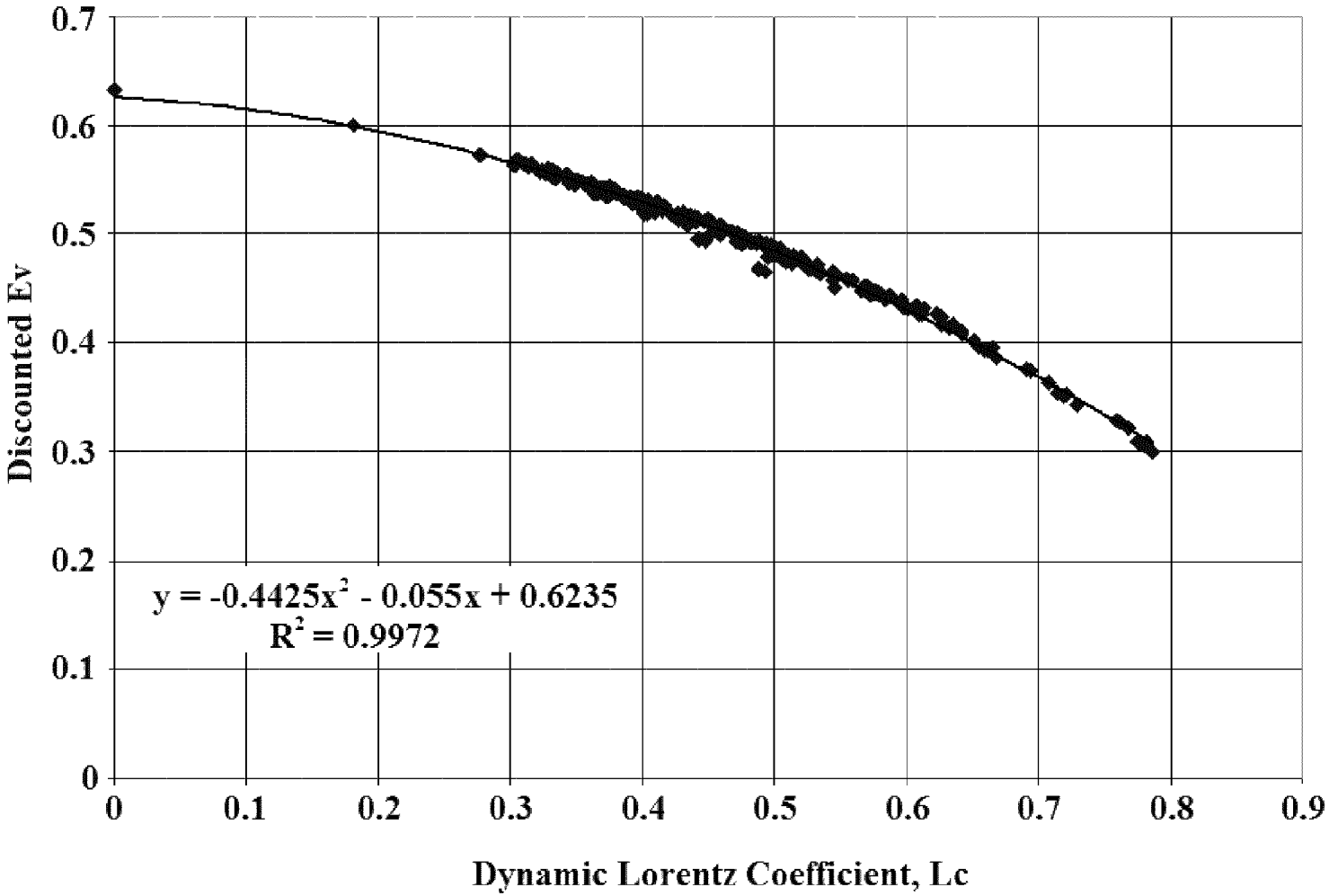
FIG. 18 is a graph of Discounted Oil Recovered vs. the Lorenz Coefficient, Lc, for a 5-spot well pattern, in accordance with an aspect of the present invention.

FIG. 18 shows results of Discounted Oil Recovered vs. the Lorenz Coefficient, Lc, for the 5-spot well pattern. The Lorenz Coefficient appears to be an excellent indicator of dynamic heterogeneity in this study. The Lorenz Coefficient appears to be a slightly better indicator of dynamic heterogeneity in this study compared to sweep efficiency at one pore volumes injected since the curve approaches the theoretical limit.

Therefore, of the seven examples of the Dynamic Heterogeneity Index, only four appear to be robust measure of the variably heterogeneous earth models studied in this example. To further identify the most robust measure in this example, the four examples of the Dynamic Heterogeneity Index are shown in FIGS. 19-22 for both well patterns.

Figure 19:
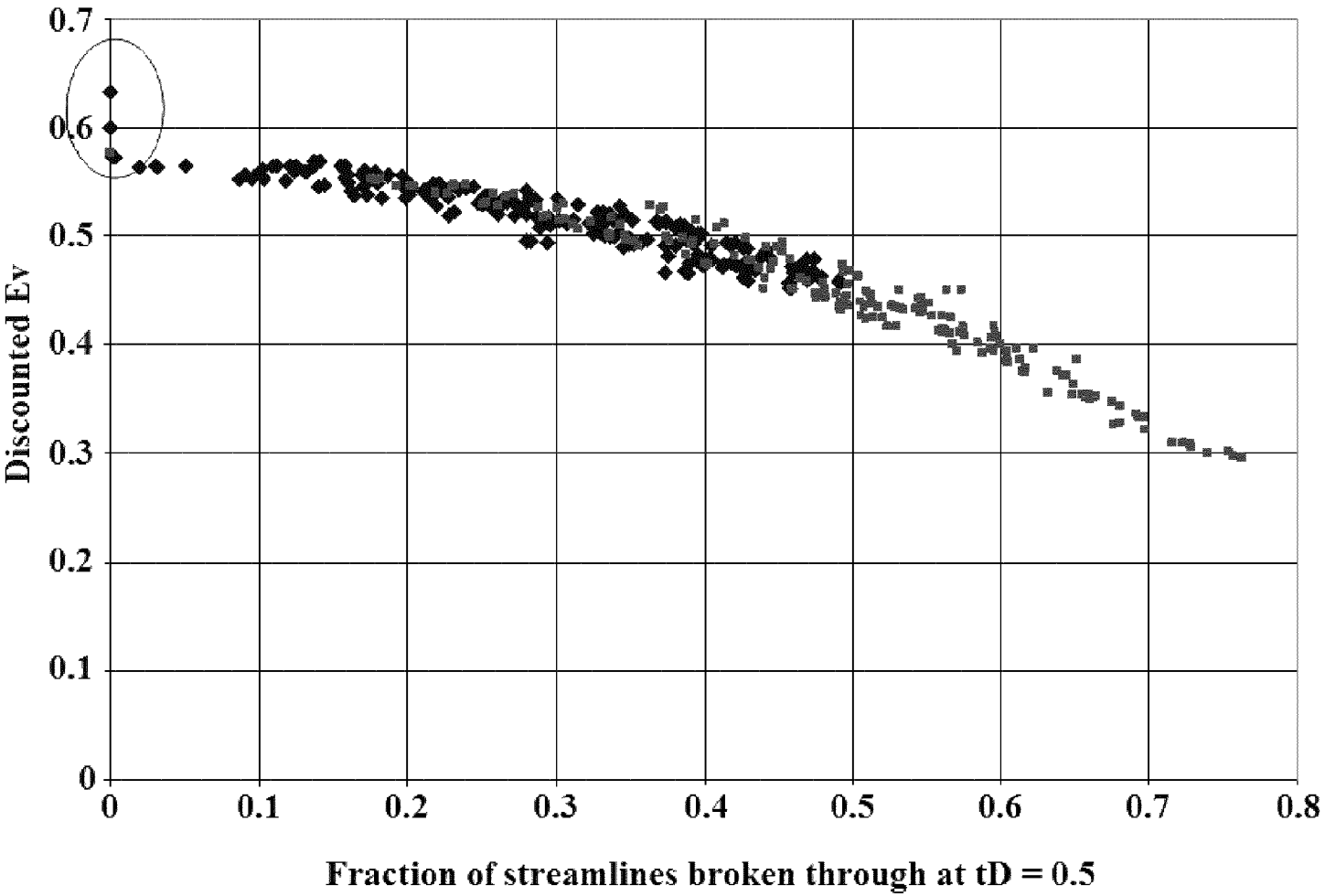
FIG. 19 is a graph of Discounted Oil Recovered vs. the fraction of streamlines broken through at 0.5 pore volumes injected for a 5-spot well pattern, in accordance with an aspect of the present invention.

FIG. 19 shows results of Discounted Oil Recovered vs. the fraction of streamlines broken through at 0.5 pore volumes injected.

Figure 20:
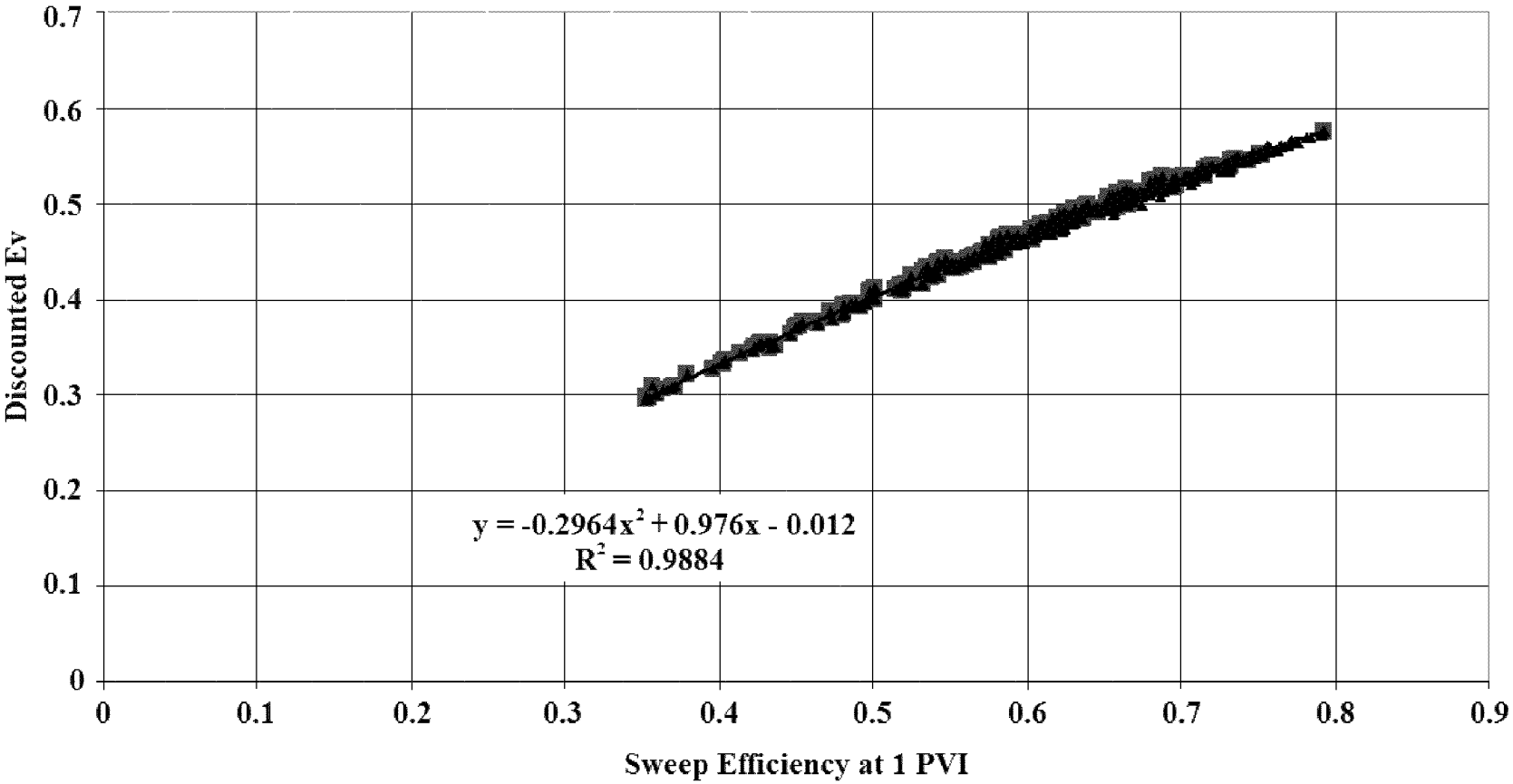
FIG. 20 is a graph of Discounted Oil Recovered vs. the sweep efficiency at one pore volume injected, in accordance with an aspect of the present invention.

FIG. 20 shows results of Discounted Oil Recovered vs. the sweep efficiency at one pore volume injected.

Figure 21:
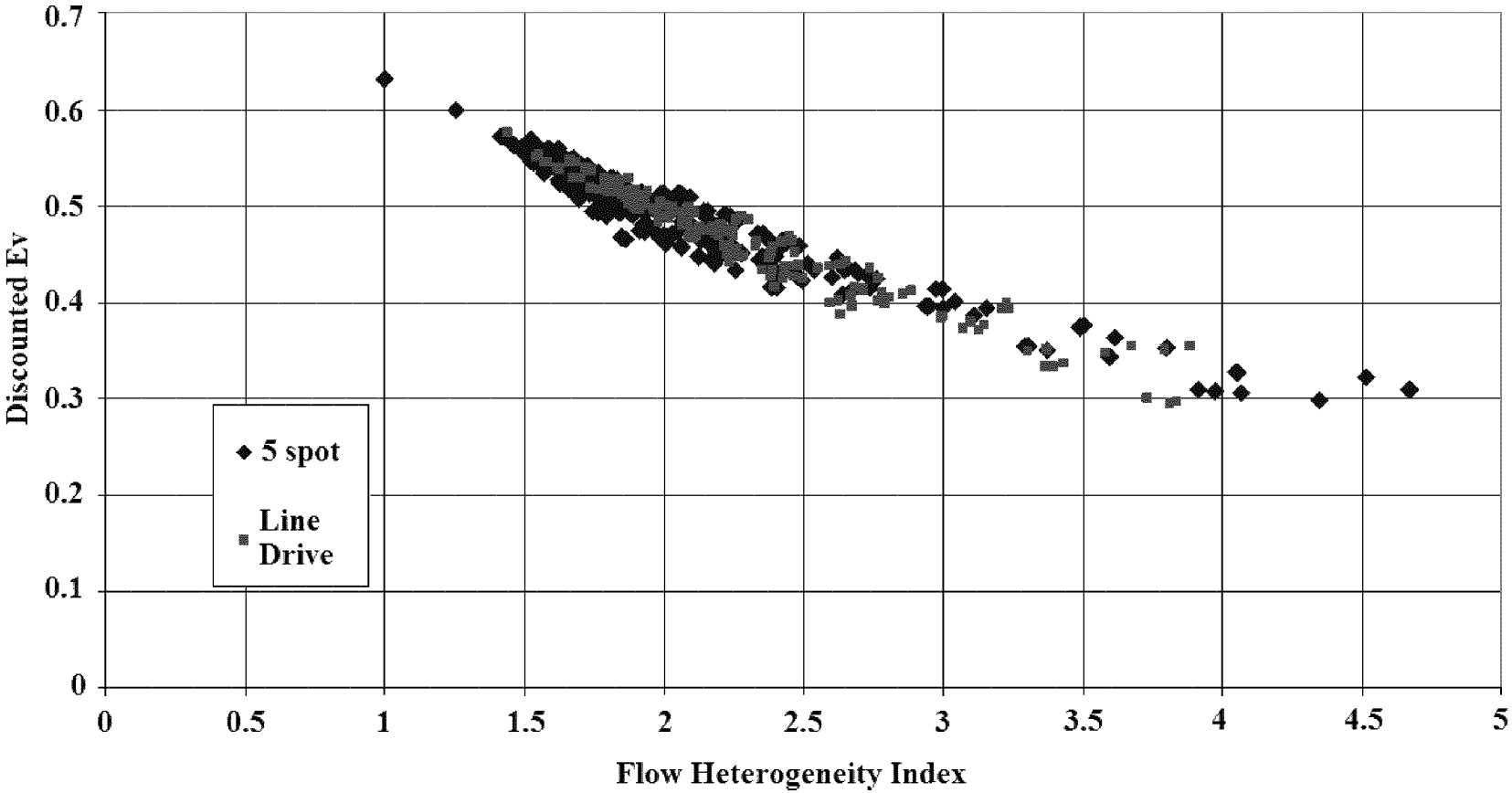
FIG. 21 is a graph of Discounted Oil Recovered vs. the Flow Heterogeneity Index, in accordance with an aspect of the present invention.

FIG. 21 shows results of Discounted Oil Recovered vs. the Flow Heterogeneity Index.

Figure 22:
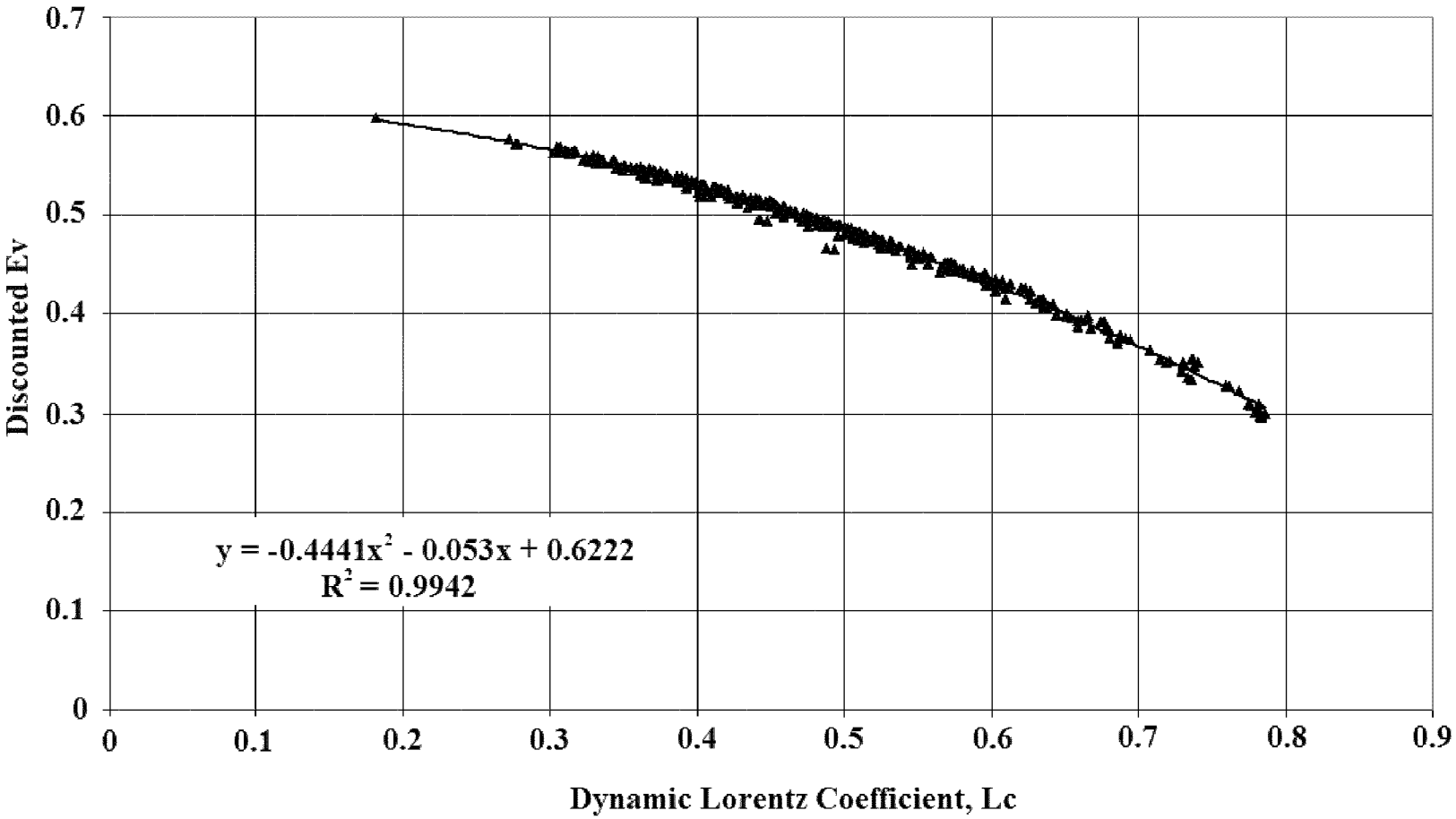
FIG. 22 is a graph of Discounted Oil Recovered vs. the Lorenz Coefficient, in accordance with an aspect of the present invention.

FIG. 22 shows results of Discounted Oil Recovered vs. the Lorenz Coefficient.

All four of the measures appear to be acceptable measures of dynamic heterogeneity in this study, though two show much more variability than the other two. In particular, the fraction of streamlines broken through at 0.5 pore volumes injected, F at $t_D$=0.5, and the Flow Heterogeneity Index, FHI, appear to have more variability between the two well patterns. Sweep efficiency at one pore volume injected and the Lorenz Coefficient both show small variation over the complete set of earth models considered for both well patterns.

The Lorenz Coefficient, Lc, is selected as the Dynamic Heterogeneity Index in this study, as it appears to be the most robust example of the dynamic measure of heterogeneity. Discounted Oil Recovered goes to the correct limits for Lc=0, while the sweep efficiency at one pore volume injected, Ev at $t_D$=1, fails to do so. Curve fit parameters also changed more for the sweep efficiency at one pore volume injected curve compared to the Lorenz Coefficient curve when the second well pattern was included.

What is claimed is:

1. A computer-implemented method for determining a dynamic heterogeneity of a subsurface reservoir, the method comprising: (a) providing an earth model representing a subsurface reservoir; (b) performing a streamline analysis to identify a plurality of streamlines indicative of flow geometry within the earth model; (c) determining a flow and storage capacity for the earth model responsive to the streamline analysis wherein determining the flow and storage capacity for the earth model includes assembling a curve comparing flow capacity against storage capacity and wherein the curve comparing flow capacity against storage capacity is assembled by ordering the plurality of streamlines indicative of flow geometry within the earth model according to increasing residence time; (d) calculating a dynamic heterogeneity for the earth model responsive to the flow and storage capacity for the earth model; and (e) displaying the dynamic heterogeneity for the earth model.

2. The method of claim 1, wherein: steps (a)-(d) are repeated for a plurality of earth models representing the subsurface reservoir; and the dynamic heterogeneity for the plurality of earth models are displayed in step (e).

3. The method of claim 2, further comprising: (f) ranking the plurality of earth models responsive to a production performance metric.

4. The method of claim 3, wherein the production performance metric is selected from the group consisting of a discounted oil rate, an ultimate hydrocarbon recovery, and a net present value.

5. The method of claim 1, wherein the flow and storage capacity for the earth model in step (c) is determined using the following equations:

$$F_i = \frac{\sum_{j=1}^{i} q_j}{\sum_{j=1}^{N} q_i} \text{ and } \Phi_i = \frac{\sum_{j=1}^{i} Vp_j}{\sum_{j=1}^{N} Vp_j}$$

where F represents flow capacity, q represents volumetric flow rate, (Φ) represents storage capacity, and Vp represents pore volume.

6. The method of claim 1, wherein the flow capacity of the earth model is determined by calculating a volumetric flow for each of the plurality of streamlines indicative of flow geometry within the earth model.

7. The method of claim 1, wherein the storage capacity of the earth model is determined by calculating a pore volume for each of the plurality of streamlines indicative of flow geometry within the earth model.

8. The method of claim 7, wherein the pore volume for each of the plurality of streamlines is determined by calculating a time of flight and a volumetric flow rate of the streamline.

9. The method of claim 1, wherein the calculating the dynamic heterogeneity for the earth model in step (d) is performed by calculating one of the following selected from the group consisting of a Lorenz Coefficient, a Flow Heterogeneity Index, a sweep efficiency at about one pore volume injected, and a fraction of streamlines broken through at about 0.5 pore volumes injected.

10. The method of claim 1, wherein the dynamic heterogeneity for the earth model is determined responsive to a tracer test.

11. The method of claim 1, wherein the dynamic heterogeneity for the earth model is used to determine how altering static properties of the earth model influence a predicted production performance of the subterranean reservoir.

12. A computer-implemented method for determining a dynamic heterogeneity of a subsurface reservoir, the method comprising: (a) providing a plurality of reservoir models representing a subsurface reservoir; (b) identifying a plurality of streamlines indicative of flow geometry within the subsurface reservoir for each of the plurality of reservoir models; (c) constructing a flow and storage capacity curve for each of the plurality of reservoir models by ordering the plurality of streamlines for each of the plurality of reservoir models according to increasing residence time; (d) calculating a dynamic heterogeneity for each of the plurality of reservoir models responsive to the flow and storage capacity curve for each of the plurality of reservoir models; and (e) displaying the dynamic heterogeneity for the plurality of reservoir models to rank the plurality of reservoir models responsive to a production performance metric.

13. The method of claim 12, wherein the calculating the dynamic heterogeneity for each of the plurality of reservoir models in step (d) is performed by calculating one of the following selected from the group consisting of a Lorenz Coefficient, a Flow Heterogeneity Index, a sweep efficiency at about one pore volume injected, and a fraction of streamlines broken through at about 0.5 pore volumes injected.

14. The method of claim 12, wherein the production performance metric is selected from the group consisting of a discounted oil rate, an ultimate hydrocarbon recovery, and a net present value.

15. The method of claim 12, wherein the plurality of streamlines indicative of flow geometry within the subsurface reservoir in step (b) is identified responsive to a tracer test.

16. A computer-implemented method for determining a dynamic heterogeneity of a subsurface reservoir, the method comprising: (a) providing an earth model representing a subsurface reservoir; (b) identifying a plurality of streamlines indicative of flow geometry within the earth model; (c) determining a flow and storage capacity for the earth model responsive to the streamlines indicative of flow geometry within the earth model comprising ordering the plurality of streamlines for each of the plurality of reservoir models according to increasing residence time; (d) calculating a Lorenz Coefficient for the earth model responsive to the flow and storage capacity of the earth model; and (e) displaying the Lorenz Coefficient for the earth model.

17. The method of claim 16, wherein: the displaying the Lorenz Coefficient for the earth model in step (d) comprises plotting the Lorenz Coefficient for the earth model versus a production performance metric.

18. The method of claim 17, wherein: the production performance metric is selected from the group consisting of a discounted oil rate, an ultimate hydrocarbon recovery, and a net present value.

* * * * *